US012806476B2

(12) United States Patent
Christiano et al.

(10) Patent No.: US 12,806,476 B2
(45) Date of Patent: Nov. 24, 2026

(54) LEADERBOARD SYSTEMS AND METHODS FOR EXERCISE EQUIPMENT

(71) Applicant: Peloton Interactive, Inc., New York, NY (US)

(72) Inventors: Noah Christiano, New York, NY (US); Xu Liu, New York, NY (US); Jay Patel, Bloomfield, NJ (US); Augustus Chang, New York, NY (US); Deep Parekh, New York, NY (US); Keerthan Jaic, London (GB); Masha Schneider, Guttenberg, NJ (US); Alexey Zankevich, Fort Lee, NJ (US)

(73) Assignee: Peloton Interactive, Inc., New York, NY (US)

( * ) Notice: Subject to any disclaimer, the term of this patent is extended or adjusted under 35 U.S.C. 154(b) by 85 days.

(21) Appl. No.: 18/736,417

(22) Filed: Jun. 6, 2024

(65) Prior Publication Data

US 2024/0316409 A1 Sep. 26, 2024

Related U.S. Application Data

(63) Continuation of application No. PCT/US2022/054198, filed on Dec. 28, 2022, and a (Continued)

(51) Int. Cl.
*A63B 24/00* (2006.01)

(52) U.S. Cl.
CPC ..... *A63B 24/0084* (2013.01); *A63B 24/0062* (2013.01); *A63B 2024/0068* (2013.01); *A63B 2225/20* (2013.01)

(58) Field of Classification Search
CPC ..... A63B 24/0084; G09B 19/003; G09B 19/0038
See application file for complete search history.

(56) References Cited

U.S. PATENT DOCUMENTS 11,040,247 B2 * 6/2021 Casalini ..... A63B 71/0622
2005/0106543 A1 5/2005 Day et al.
(Continued)

FOREIGN PATENT DOCUMENTS

CN 1788813 A 6/2006
CN 1788814 A 6/2006
(Continued)

*Primary Examiner* — Peter R Egloff
(74) *Attorney, Agent, or Firm* — Haynes and Boone, LLP

(57) ABSTRACT

Systems and methods for generating a sampled leaderboard for display on a local exercise system include receiving a request from a local exercise system to start an on-demand class, delivering content for the on-demand class, downloading a leaderboard for the on-demand class including applying a filter to the leaderboard to generate a filtered leaderboard for a user of the local exercise system, determining whether the filtered leaderboard to be downloaded to the local system has a size less than a threshold value, generating a sampled leaderboard if the size of the filtered leaderboard to be downloaded is greater than the threshold value, wherein the sampled leaderboard is generated with a size less than the threshold value, and downloading the filtered leaderboard and/or the sampled leaderboard. An approximate rank for the user on a full leaderboard is determined and displayed to provide comparative performance results for the user.

20 Claims, 19 Drawing Sheets

Related U.S. Application Data continuation-in-part of application No. 17/543,704, filed on Dec. 6, 2021, now Pat. No. 12,023,548, which is a continuation of application No. PCT/US2020/042206, filed on Jul. 15, 2020.

(60) Provisional application No. 63/295,789, filed on Dec. 31, 2021, provisional application No. 62/954,353, filed on Dec. 27, 2019, provisional application No. 62/881,337, filed on Jul. 31, 2019.

(56) References Cited

U.S. PATENT DOCUMENTS

| | | | | |
|---|---|---|---|---|
| 2009/0118100 | A1 | 5/2009 | Oliver et al. | |
| 2012/0029666 | A1 | 2/2012 | Crowley et al. | |
| 2014/0038781 | A1 | 2/2014 | Foley et al. | |
| 2014/0122494 | A1 | 5/2014 | Thurston et al. | |
| 2014/0213372 | A1 | 7/2014 | Liang | |
| 2015/0106052 | A1 | 4/2015 | Balakrishnan et al. | |
| 2015/0251055 | A1 | 9/2015 | Ashby | |
| 2016/0089574 | A1 | 3/2016 | Henning et al. | |
| 2016/0121165 | A1 | 5/2016 | Foley et al. | |
| 2017/0249402 | A1 | 8/2017 | Liu et al. | |
| 2018/0015345 | A1* | 1/2018 | Wrigg | G09B 19/0038 |
| 2018/0056132 | A1 | 3/2018 | Foley et al. | |
| 2018/0318647 | A1 | 11/2018 | Foley et al. | |
| 2021/0299520 | A1* | 9/2021 | Evancha | A63B 24/0087 |

FOREIGN PATENT DOCUMENTS

| | | |
|---|---|---|
| CN | 105975222 A | 9/2016 |
| WO | WO 2021/021447 | 2/2021 |

* cited by examiner

LEADERBOARD SYSTEMS AND METHODS FOR EXERCISE EQUIPMENT

CROSS-REFERENCE TO RELATED APPLICATIONS

This application is a continuation of International Patent Application No. PCT/US2022/054198 filed Dec. 28, 2022, and entitled "LEADERBOARD SYSTEMS AD METHODS FOR EXERCISE EQUIPMENT," which claims priority to and the benefit of U.S. Provisional Application No. 63/295,789, filed Dec. 31, 2021, all of which are incorporated herein by reference in their entirety.

This application is also a continuation-in-part of U.S. patent application Ser. No. 17/543,704 filed Dec. 6, 2021, which is a continuation of U.S. International Application No. PCT/US2020/042206 filed Jul. 15, 2020, titled "LEADERBOARD SYSTEMS AND METHODS FOR EXERCISE EQUIPMENT," which claims the benefit of and priority to U.S. Provisional Patent Application No. 62/881,337, filed Jul. 31, 2019, titled "LEADERBOARD SYSTEMS AND METHODS FOR EXERCISE EQUIPMENT," and U.S. Provisional Patent Application No. 62/954,353, filed Dec. 27, 2019, titled "LEADERBOARD SYSTEMS AND METHODS FOR EXERCISE EQUIPMENT," all of which are incorporated herein by reference in their entirety.

TECHNICAL FIELD

The present application relates generally to the field of exercise equipment and methods, and more specifically for example, to systems and methods for providing live streaming and/or on-demand exercise content including comparative user performance leaderboards.

BACKGROUND

Humans are competitive by nature, striving to improve their performance both as compared to their own prior efforts and as compared to others. Humans are also drawn to games and other diversions, such that even tasks that a person may find difficult or annoying can become appealing if different gaming elements are introduced. Existing home and gym-based exercise systems and methods frequently lack key features that allow participants to effectively compete with each other and/or that gamify exercise activities.

To improve the exercise experience and provide a more engaging environment, gyms offer classes such as cycling classes where the instructor and participants exercise on stationary bikes often accompanied by music. The instructor, music and other class participants combine to motivate participants to work harder and maintain better pedal cadence or tempo. More recently, boutique cycling studios have taken the cycling class concept to dedicated spaces to create even more powerful class experiences. These gym and boutique classes are typically accessible only at specific times and locations and may be unavailable and expensive for many potential users.

One solution is to provide a stationary bike or other exercise apparatus that incorporates multimedia inputs and outputs for live streaming or archived instructional content, socially networked audio and video chat, networked performance metrics and competition capabilities, along with a range of gamification features. For example, U.S. Pat. No. 10,322,315, filed Jul. 16, 2018, titled "Exercise System and Method," which is incorporated herein by reference in its entirety, discloses a stationary bike local system that is configured to display a leaderboard to allow the user to see their performance in comparison to others taking the same live online or archived class.

As the user base for such exercise systems grows, there is a need to scale a large volume of user, class and performance data, including leaderboard data, while preserving the current user experience, which includes on-demand, online, and/or real-time interactions during an exercise class. These needs to provide on demand and real time access to a large volume of archived data while providing the user with a simulated live experience poses numerous challenges due to processing, memory, network bandwidth, and other system constraints. In view of the foregoing, there is a continued need in the art for improved systems and methods for delivering leaderboard and other exercise content to users of exercise equipment.

SUMMARY

The present disclosure includes improved systems and methods for compiling, storing and delivering leaderboard content for exercise equipment. The present disclosure addresses a need for scalable systems and methods for providing a large volume of on-demand leaderboard data, while preserving the user experience of a large and/or growing user base. In various embodiments, the system compresses workout data for a live and/or archived class and reconstructs a global leaderboard when serving content. In some embodiments, the leaderboard delivered to the exercise equipment is sampled and/or filtered, further reducing the size of the leaderboard and the processing and bandwidth requirements. The systems and methods disclosed herein provide many advantages over convention systems and methods, including reduced storage space, reduced network overhead and ability to scale horizontally.

In various embodiments, a system includes an exercise apparatus comprising one or more sensors, a processing system configured to generate one or more performance metrics based at least in part on signals received from the one or more sensors, and a display configured to display an exercise class, performance metrics, and a leaderboard comparing user performance to stored class participant data, wherein the leaderboard comprises stored class participant data from prior sessions of the exercise class.

The system may further include a distribution server configured to receive a request from the processing system to start an on-demand class, deliver content for the on-demand class to the processing system, and download leaderboard data for the on-demand class to the processing system. The leaderboard data may be compiled by determining whether the leaderboard data to be downloaded to the processing system has a size greater than a threshold value, generating a sampled leaderboard if the size of the leaderboard data to be downloaded is greater than the threshold value, wherein the sampled leaderboard comprises a subset of the leaderboard data that has a size less than or equal to the threshold value, and downloading the sampled leaderboard to the processing system.

In some embodiments, the processing system is further configured to sort the sampled leaderboard by the output to generate a ranked leaderboard corresponding to an identified timestamp associated with the exercise class, and the display is configured to display the sampled leaderboard and update the displayed sampled leaderboard in accordance with output data for the identified timestamp associated with the exercise class.

The processing system may be further configured to determine an approximate rank for the user on a full leaderboard, and display comparative performance results for the user. The processing system is further configured to calculate a spacing between other users' workouts near the user of the exercise apparatus based on associated output values, wherein the calculated spacing projects a rank for the user onto the full leaderboard, and populating a leaderboard window on the display using the user's projected rank to rank the other sampled workouts thereby providing the user with a window into a full leaderboard.

In some embodiments, the sensors are configured to measure movement and/or settings of the exercise apparatus, and wherein the processing system is configured to generate the one or more performance metrics comprising cadence, power, and/or resistance. The sensors comprise a heart rate monitor, and/or a video capture component configured to capture images of a user operating the exercise apparatus.

In some embodiments, the processing system is configured to transmit session data to the distribution server, including sensor data, performance metrics, and/or user preference information. The distribution server may be configured to serve media associated with the exercise class comprising video, audio, and/or performance data from a workout and/or media content database, and leaderboard information from a leaderboard system to the processing system associated with the exercise apparatus.

In some embodiments, the leaderboard information includes a full leaderboard of all stored users, a filtered leaderboard and/or a sampled leaderboard. A distribution platform and/or the processing system associated with the exercise apparatus is configured to deliver workout data to a leaderboard system that is configured to compile, compress and store workout data in a leaderboard database. The distribution platform may be further configured to filter and/or sample the leaderboard data, by generating a subset of the leaderboard data for display to the user, based at least in part on user selected criteria comprising other users, location, age, gender, and/or performance metrics. The distribution platform may be further configured to sample the leaderboard data to reduce a size of the leaderboard in accordance with processing, memory and/or networking constraints while providing the user with simulated competition against a full leaderboard during the exercise class.

In various embodiments, a method for generating a sampled leaderboard for display on a local exercise system includes receiving a request from a local exercise system to start an on-demand class, delivering content for the on-demand class, downloading a leaderboard for the on-demand class including applying a filter to the leaderboard to generate a filtered leaderboard for a user of the local exercise system, determining whether the filtered leaderboard to be downloaded to the local system has a size less than a threshold value, generating a sampled leaderboard if the size of the filtered leaderboard to be downloaded is greater than the threshold value, wherein the sampled leaderboard is generated with a size less than the threshold value, and downloading the filtered leaderboard and/or the sampled leaderboard. An approximate rank for the user on a full leaderboard is determined and displayed to provide comparative performance results for the user.

In some embodiments, the method further includes updating the sampled leaderboard in accordance with output data for an identified timestamp associated with the on-demand class, sorting the leaderboard by the output to generate a ranked leaderboard corresponding to the identified timestamp associated with the on-demand class, incorporating users currently taking the on-demand class into a ranking using current user output metrics, determining an approximate rank on the leaderboard for the user, and/or displaying on the local exercise system comparative performance results for the user. The method may further include sorting the sampled leaderboard based on a total performance output of each user for a current portion of the on-demand class, determining the current user's position in the sorted sampled leaderboard, calculating a spacing between other users' workouts near the user of the local exercise system based on associated output values, wherein the calculated spacing projects a rank for the user onto the full all-time leaderboard, and/or populating a leaderboard window on the user's display using the user's projected rank to rank the other sampled workouts thereby providing the user with a window into a full all-time leaderboard.

The scope of the present disclosure is defined by the claims, which are incorporated into this section by reference. A more complete understanding of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

In various embodiments of the present disclosure, improved systems and methods for compiling, storing and delivering leaderboard content for exercise equipment are provided. The present disclosure addresses a need for scalable systems and methods for providing a large volume of on-demand leaderboard data, while preserving the user experience of a large and/or growing user base. In various embodiments, the system compresses workout data for a live and/or archived class, reconstructs a global leaderboard, and/or implements a sampled and/or filtered leaderboard when serving content to provide the user with a competitive experience measured against a large universe of riders (e.g., over 10,000, 50,000, 100,000, etc. riders). The systems and methods disclosed herein provide many advantages over convention systems and methods, including reduced storage space, reduced network overhead and the ability to scale horizontally.

Figure 1A:
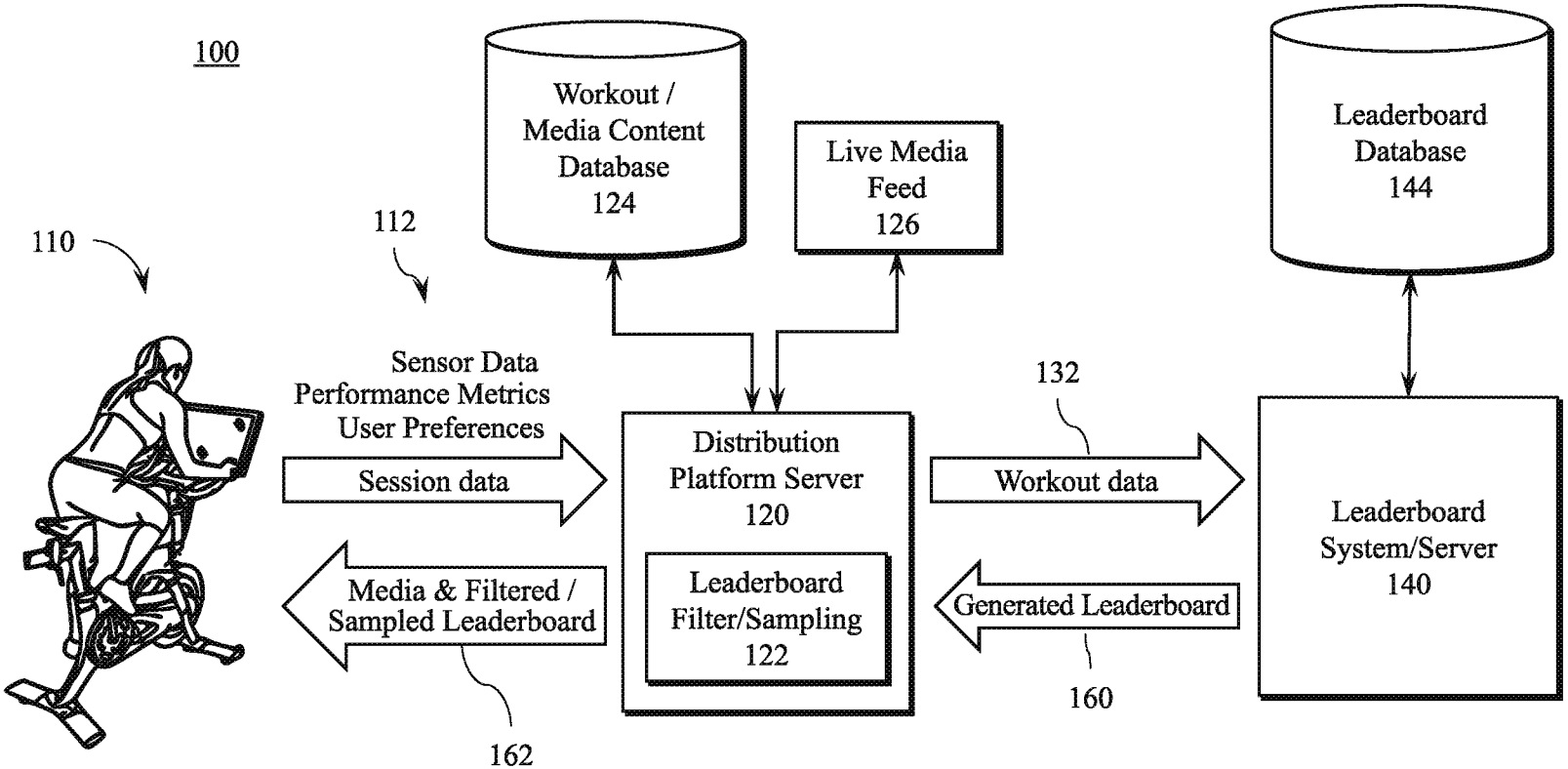
FIG. 1A illustrates an example local exercise system for implementing a sampled leaderboard system, in accordance with one or more embodiments of the present disclosure.
Figure 1B:
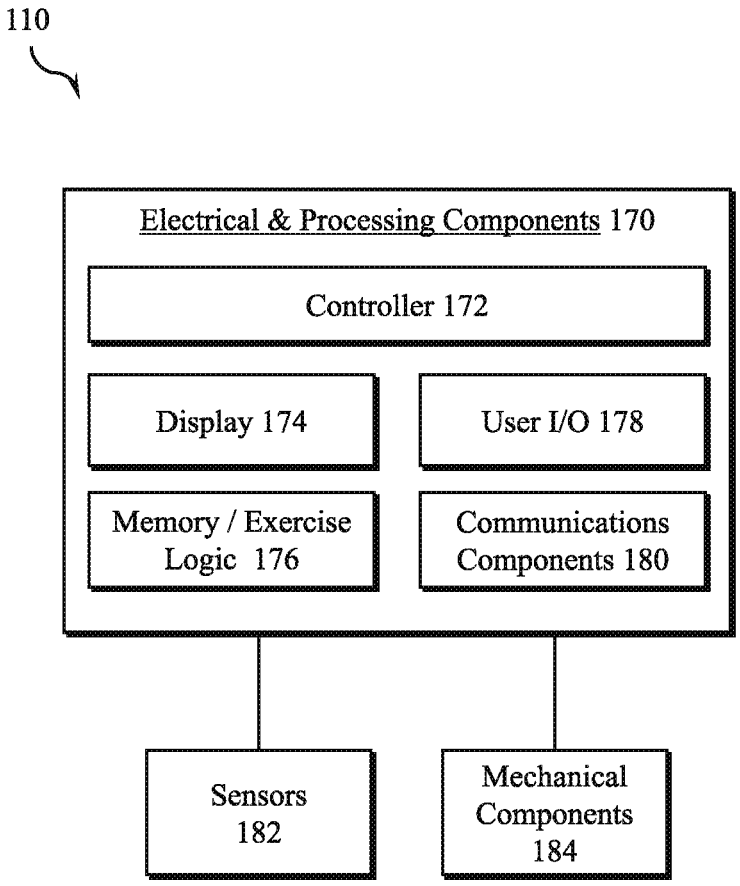
FIG. 1B illustrates example electrical components for a local exercise system, in accordance with one or more embodiments of the present disclosure.

Referring to FIGS. 1A and 1B, an example exercise system 100 will now be described in accordance with various embodiments of the present disclosure. A local system 110 includes an exercise apparatus that includes one or more sensors 182, a processing system (e.g., as illustrated in FIG. 1B) that generates one or more performance metrics and a display 174 for displaying an exercise class, performance metrics, a leaderboard comparing user performance to other users, elapsed time, calories burned, distance traveled, and/or other information. The exercise apparatus may include an exercise cycle, a treadmill, a rowing machine, a weight machine or other exercise equipment. The one or more sensors 182 include sensor(s) that measure movement, status and/or settings of the exercise apparatus and/or user. For example, the sensor(s) 182 can generate signals and/or data for use by the controller 172 to generate performance data such as cadence, power, and/or resistance on an exercise cycle, or other performance data as appropriate for the exercise apparatus. The sensors 182 may further include other sensors such as a heart rate monitor, an image or video capture component (e.g., a camera) capturing images of the user during exercise, and/or other sensors as appropriate for the exercise apparatus. The processing system may include a controller 172 and memory 176 for executing logic to operate the exercise apparatus as described herein.

The electrical and processing components 170 of the local system 110 facilitate the operation of an exercise apparatus, including communications with the user, control of various mechanical components 184 (e.g., a linear actuator, resistance, etc.), and receiving and processing sensor data (e.g., from sensors 182). In various embodiments, the electrical and processing components 170 include the controller 172, a display 174, the memory 176 including exercise logic, user intput/output components 178, and communications components 180.

The controller 172 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operations of the exercise apparatus. In this regard, the controller 172 may execute machine readable instructions (e.g., software, firmware, or other instructions) stored in the memory 176.

The memory 176 may store exercise data and exercise logic for execution by the controller 172. In some embodiments, the exercise logic may be implemented as circuitry and/or a machine readable medium storing various machine readable instructions and data. For example, in some embodiments, exercise logic may include an operating system and one or more applications as machine readable instructions that may be read and executed by controller 172 to perform various operations described herein. In some embodiments, memory 176 may be implemented as non-volatile memory (e.g., flash memory, hard drive, solid state drive, or other non-transitory machine readable mediums), volatile memory, or combinations thereof. The exercise logic may include status, configuration and control features which may include various control features disclosed herein. In some embodients, the exercise logic executes an exercise class (e.g., live or archived) which may include an instructor and one or more other class participants. The exercise class may include a leaderboard and/or other comparative performance parameters for display to the user during the exercise class.

Communications components 180 may include wired and/or wireless interfaces. Wired interfaces may include communications links local and networks systems, and may be implemented as one or more physical networks or device connect interfaces. Wireless interfaces may be implemented as one or more WiFi, Bluetooth, cellular, infrared, radio, and/or other types of network interfaces for wireless communications, and may facilitate communications with the operator terminal, and other wireless devices.

Display 174 presents information to the user of the local system 110. In various embodiments, display 174 may be implemented as an LED display, a liquid crystal display (LCD), an organic light emitting diode (OLED) display, and/or any other appropriate display. User input/output components 178 receive user input to operate features of the local system, and may be intergrated with the display 174 as a touchscreen display.

The exercise system 100 is configured to facilitate delivery of exercise class content, such as video and audio media instructing the user during a session of the exercise class, to the local system 110. During a session of an exercise class, the local system 110 transmits session data 112 to the distribution platform 120. In various embodiments, the session data 112 may include sensor data (e.g., resistance, cadence, user heartrate), performance metrics (e.g., speed, distance, position on leaderboard), user preference information (e.g., favorite music, workout preferences), and/or other session data. The distribution platform 120 is configured to serve media 162 associated with the exercise class (e.g., video, audio and other workout content from a workout/media content database 124, leaderboard information from a leaderboard system 140, live media from a live media feed 126) to the local system 110. In some implementations, the leaderboard information may include the full leaderboard, a filtered leaderboard and/or a sampled leaderboard as described herein.

The distribution platform 120 and/or the local system 110 provide workout data 132 to a leaderboard system 140 that is configured to compile, compress and store workout data in a leaderboard database 144 (e.g., cloud storage, networked storage, etc.). The leaderboard system 140 is also configured to retrieve stored leaderboard data and generate a leaderboard 160 for display to the user of the local system 110 during an exercise session. In some embodiments, the distribution platform 120 includes logic (e.g., leaderboard filtering/sampling logic 122) for filtering and/or sampling the generated leaderboard. Filtering logic is configured to generate a subset of the leaderboard for display to the user, which may be based on user selected criteria such as friends or contacts of the user, location, age, gender, performance metrics, etc. Sampling logic is configured to reduce the size of leaderboard (e.g., full leaderboard and/or filtered leaderboard) in accordance with system constraints (e.g., memory, bandwidth, etc.) while providing the user with simulated competition against the full leaderboard during the exercise class.

During operation of the exercise system 100, hardware and software within the sensors 182 or in a separate processing system (e.g., electrical and processing components 170, including controller 172 and memory 176) may be provided to calculate and store a wide range of status and performance information. Relevant performance metrics that may be measured or calculated include resistance, distance, speed, power, total work, pedal cadence, heart rate, respiration, hydration, calorie burn, and/or custom performance scores that may be developed. Where appropriate, such performance metrics can be calculated as current/instantaneous values, maximum, minimum, average, or total over time, or using any other statistical analysis. Trends can also be determined, stored, and displayed to the user, the instructor, and/or other class participants. A user interface may be provided for the user to control the language, units, and other characteristics for the information displayed, including a relative performance against the leaderboard, a filtered leaderboard, and/or a sampled leaderboard.

The exercise system 100 is configured to facilitate real-time comparison of the user's performance in an exercise class against the performance of all previous class participants that are stored in the leaderboard database 144. For example, while the user is operating the local system 110, the display may show the user's performance compared to other users on a leaderboard, including a current performance ranking that may rise or fall during the class based on the user's performance output. The display 174 may provide various display options such as filtering which allows the user to select a subset of users to display, scrolling which allows the user to scroll up/down the leaderboard, and/or other options.

Seamlessly providing these features to the user is challenging as the size of the leaderboard and number of active users grows. For example, the system may be configured to sort all users in a class by performance output every two seconds for each workout. The strain on the system will get worse with time because the size of the leaderboard will continue to increase with each new participant and class session. Embodiments disclosed herein decrease the CPU usage by using a compressed leaderboard and/or a sampled leaderboard to improve latency and increase the scalability of the exercise system 100. At the same time, the system provides a consistent leaderboard user experience regardless of leaderboard size.

A sampled leaderboard represents a subset of the full leaderboard, and the local system 110 is configured to provide an approximate rank of the user's performance output during the exercise session. Use of a sampled leaderboard as disclosed herein produces costs savings, particularly during large events, and provides additional bandwidth for higher traffic and system expansion for more users. One goal of the sampled leaderboard is to preserve the feel and functionality of a full leaderboard while keeping the costs of computing the leaderboard substantially constant as the all-time leaderboard size grows. Additional sampled leaderboard features include displaying the user's rank in real time, seeing other users ranked nearby in real time, and filtering the all-time leaderboard based on user and/or system preference. With a large enough sample set, users will have the same "big class" experience because they can only see a limited number of other participants at any one time in the leaderboard window.

In various implementations, the exercise system is configured to operate within system constraints defining a maximum leaderboard size, to keep the processing and bandwidth costs constant. One goal is to provide the user with a consistent performance and reduce latency in providing the user with an all-time leaderboard rank. For example, one system goal may be to have a $95^{th}$ percentile of latency below 300 milliseconds.

One problem with implementing a large, all-time, leaderboard is that the user rank may jump up and down between nearby users during class, making the leaderboard window unusable as a visual for the user. The sampled leaderboard disclosed herein resolves this issue by updating periodically (e.g., once a minute) for all users during the same ride. Further, having less users on the sampled leaderboard (and capping the size) can produce smoother experience for the user. For example, if the leaderboard is really large (over 100,000 users) then the user may see constant changes/jumps in ranking, but if there are less riders, the user can have a smoother result (e.g., instead of jumping 20 positions in the full leaderboard, the rank may jump 2 positions on the screen).

The sampled leaderboard may be further refined by using matchmaking, filtering and/or other sampling to give the user a better user experience by mapping the sampling in a way that is more appropriate and/or meaningful to the user. For example, the system may be configured to extract a sampled leaderboard of 10,000 riders spanning percentile output ranks, the system may recommend a filter based on user configuration, performance expectations, people who know the user, and/or other criteria.

It is recognized that the accuracy of the sampled leaderboard may change based on the sample size. In test environments, a 10,000-sample size generated low error and a satisfactory user experience. It is recognized, however, that a different sample size may be more optimal for different exercises/classes/leaderboard sizes and can be determined via test environments. Regardless of sample size, the accuracy of the sampled leaderboard methods disclosed herein increases as the class progresses, converging to the real rank by end of the exercise session. It is further noted that a percentile sampled leaderboard (sampled evenly across the leaderboard percentiles to the maximum sampled leaderboard size) consistently produces accurate results over other tested sampling approaches such as random sampling.

In some embodiments, the local system 110 is configured to process full leaderboards, filtered leaderboards, and/or sampled leaderboards. In some configurations, the local system 110 is configured to operate using the sampled leaderboard and approximated ranking with any leaderboard downloaded to the local system 110. In some embodiments, the local system 110 is configured to use the sampled leaderboard during the exercise session, and provide a final full leaderboard ranking post-class, when latency and processing constraints are less of an issue for the user experience. If a user checks the final performance ranking after an exercise class ends, the local system 110 can return the full leaderboard ranking, which may be continually changing as new users take the exercise class.

The exercise system 100 seamlessly works with the compressed leaderboard systems and methods as described further herein. The sampled leaderboard is generated by sampling the compressed workout data. The compression algorithm is then used when computing user outputs during a given workout, including decompressing the data to extract an output value for each participant, and ranking the sampled leaderboard for the given outputs.

Figure 2:
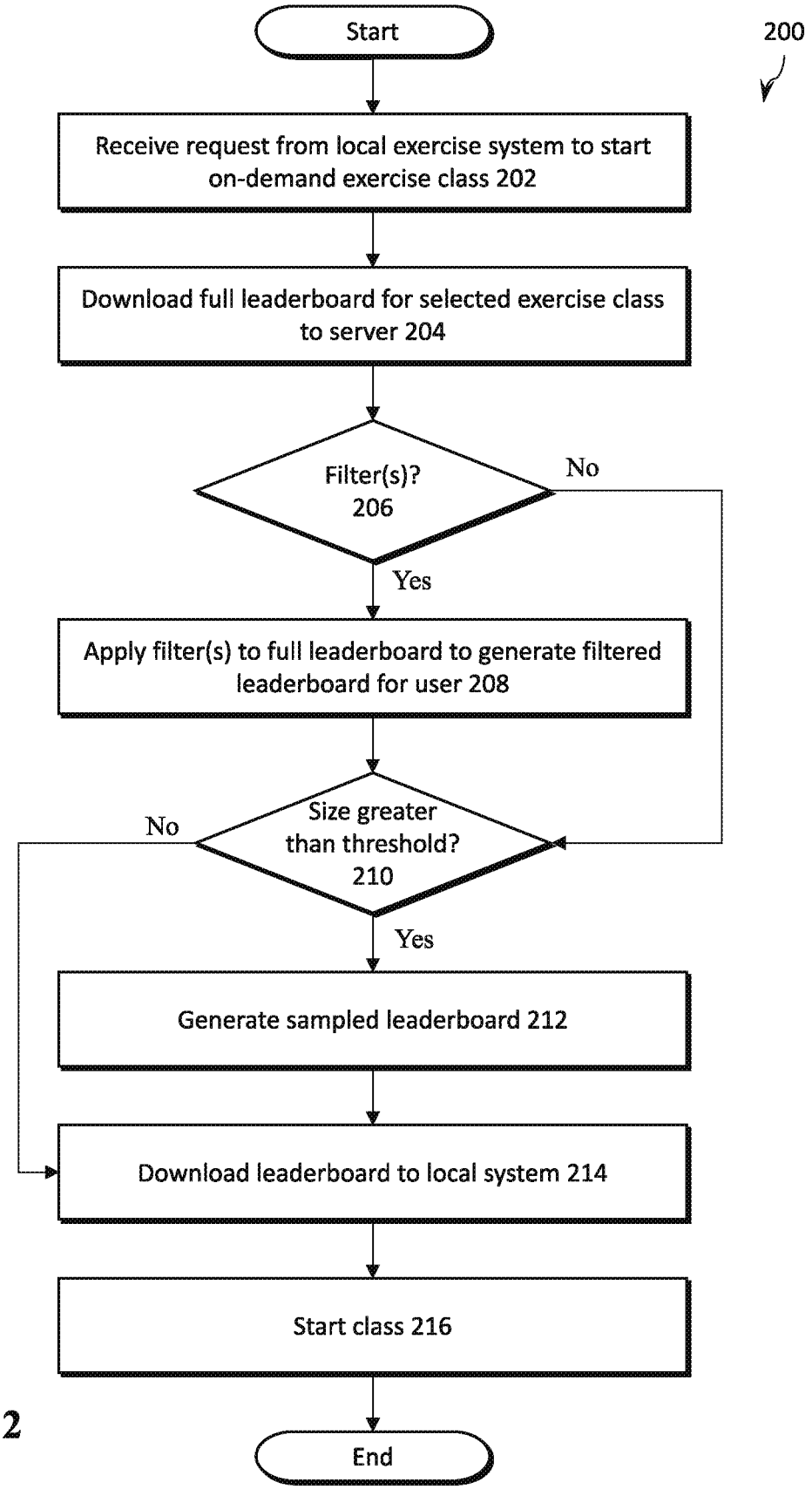
FIG. 2 illustrates a method for implementing a sampled leaderboard system, in accordance with one or more embodiments of the present disclosure.

Referring to FIG. 2, an example process 200 for implementing a sampled leaderboard (e.g., via the exercise system 100 of FIGS. 1A-B) will now be described in accordance with various embodiments. In step 202, a server of the exercise system receives a request from a local system (e.g., an exercise cycle) to start an on-demand class. For example, the local system may include a touchscreen display or other input/output components configured to display on-demand exercise classes available through the exercise system for selection by the user. The local system, for example, may be in communication with one or more servers of the exercise system to request a list of available classes, display a portion of the received class list, receive a selection from the user, and send a request to start the selected on-demand class to the server.

In step 204, the server downloads the leaderboard for the selected on-demand class. In some embodiments, the leaderboards are stored in a leaderboard database and may be stored and downloaded in a compressed format, such as described further herein. The leaderboard may include performance information for past participants in the selected class, which depending on the popularity of the class could include any number of performance results (e.g., over 100,000). If a filter is to be applied to the leaderboard (step 206), then the server applies the filter to the full leaderboard to generate a filtered leaderboard for the user (step 208). For example, the user may select one or more filter criteria to focus the set of users that the user will be competing against. Filter criteria may include gender, geographic location, age, performance level, friends/contacts, or other filter criteria. In various embodiments, the leaderboard data includes performance data spanning datapoints associated with each user's performance during the class, as well as identifying information such as name, age, gender, and location, which may be used for display to the user, filtering and other purposes. In some embodiments, the filter(s), if applied, may be selected by the user, by a class instructor, through logic on the local system and/or server(s) of the exercise system.

In step 210, if the size of the leaderboard to be downloaded (e.g., the full leaderboard, the filtered leaderboard, etc.) to the local system is less than a threshold value (e.g., 10,000 entries), then the leaderboard is downloaded to the local system (step 214). By imposing a threshold as described herein, consistent performance standards can be achieved across the network while preserving competition across the full leaderboard. If the size is greater than the threshold value, then a sampled leaderboard is generated in step 212. The sampled leaderboard reduces the size of the leaderboard to be processed and downloaded during the exercise class. For example, the sampled leaderboard can be set to have a maximum size equal to or less than the threshold size. In various embodiments, the sampled leaderboard is generated by sorting the full leaderboard and selecting entries across the range of performance outputs, for example, selecting entries at percentile intervals based on performance, such as selecting every $10^{th}$ entry from a leaderboard having 100,000 entries. It will be appreciated that other sampling approaches may be used in accordance with the teachings of the present disclosure. If the leaderboard is a compressed leaderboard, then the sampled leaderboard may be generated using the compressed data. The exercise class then starts in step 216. In some embodiments, the local system is configured to process a full leaderboard, a filtered leaderboard and/or a sampled leaderboard (i.e., whichever is downloaded to the local system) using the same leaderboard logic.

Through the process 200, the present disclosure addresses processing constraints and bandwidth limitations in the exercise system with a scalable solution that provides users with competition against a full universe of stored users. The occurrence of bottlenecks when using a full leaderboard servers may be high due the large number of local systems being served and the large number users stored in the full leaderboard. In some embodiments, the servers are configured to access the stored leaderboard and sort all users in a ride by output to produce a rider's current leaderboard ranking for display. The full sorting may be conducted at small intervals (e.g., every second, every two seconds, etc.) to provide the user with real-time performance feedback as compared to other users. The systems and methods disclosed herein decrease processing requirements of using the leaderboard, improve latency, and increase the scalability of the leaderboard. At the same time, the systems and methods disclosed herein maintain the user experience of competing against the users in the full leaderboard.

The systems and methods may be implemented using various software, hardware and data structures as appropriate for a particular implementation. For example, in one approach a software architecture may include an inherited class structure comprising a leaderboard class, a sampled leaderboard, and an abstract leaderboard for use on the local system. In some systems, caching may be used to create a new sampled leaderboard each time a new workout is implemented. For example, there may be thousands of new on demand workouts for the same ride every hour. By caching the sampled leaderboard with the full leaderboard, the sampled leaderboard can be retrieved directly by each local system that demands the same ride, thereby reducing the number of times a ride needs to be sampled. In this implementation, sampling (see step 212) can be triggered if the sampled ride is not in the cache. One drawback of caching in this manner is that a popular ride could generate new rider data that is not considered in the cached sampled leaderboard. However, resampling a cached ride after a number of exercise sessions (e.g., every 1,000 exercise sessions) are completed and/or after the passage of time (e.g., every hour) will lessen the impact on the overall results of subsequent workouts.

Figure 3A:
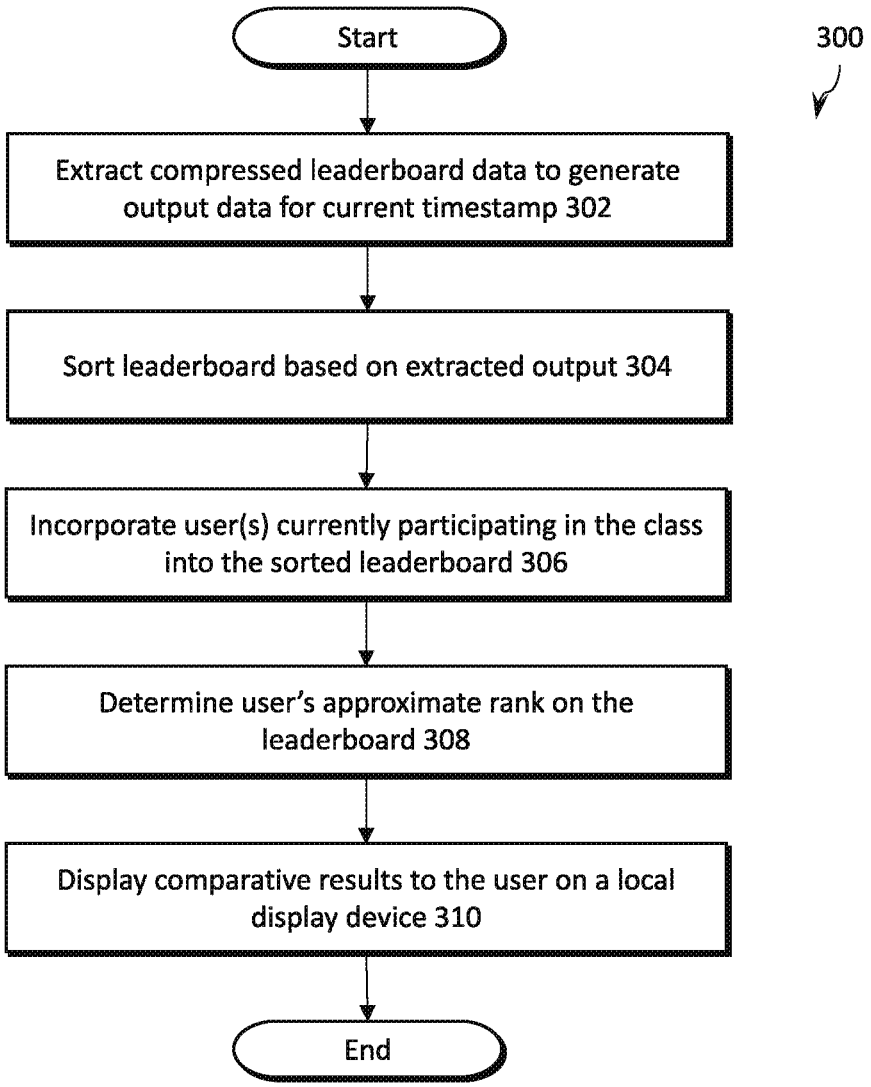
FIG. 3A illustrates an example method for determining a user's approximate rank on the full leaderboard in a sampled leaderboard system, in accordance with one or more embodiments of the present disclosure.

Further aspects of the leaderboard systems and methods will now be described in greater detail. In one implementation, the local system (e.g., a client device) interacts with a copy of the leaderboard downloaded to the local system. To provide a consistent user experience, the local system sorts the leaderboard by output based on a timestamp for the exercise class (e.g., a current timestamp, a future timestamp, etc.) at regular intervals (e.g., every 2 seconds). Referring to FIG. 3A, an example method 300 for determining a user's approximate rank on the full leaderboard in a sampled leaderboard system is illustrated, in accordance with one or more embodiments of the present disclosure.

In this embodiment, a compressed leaderboard is described, however, it will be appreciated that the method for approximating a user's rank may also be implemented using a leaderboard that is not compressed. In step 302, the compressed leaderboard is updated to find output data for the current timestamp associated with the exercise class. For example, a compressed leaderboard is decompressed to extract each participant's output metrics for the timestamp. In step 304, the leaderboard is sorted by the extracted output to generate a ranked leaderboard corresponding to the designated timestamp for the exercise class. In step 306, users currently taking the exercise class are incorporated into the ranking using their current output metrics. In step 308, the user's approximate rank on the leaderboard is determined. When the full leaderboard is used, the approximate rank may correspond to the sorted rank identified in step 306. When a filtered and/or sampled leaderboard is used, the user's corresponding rank in the full leaderboard may be determined as described herein with respect to the method of FIG. 4.

Figure 3B:
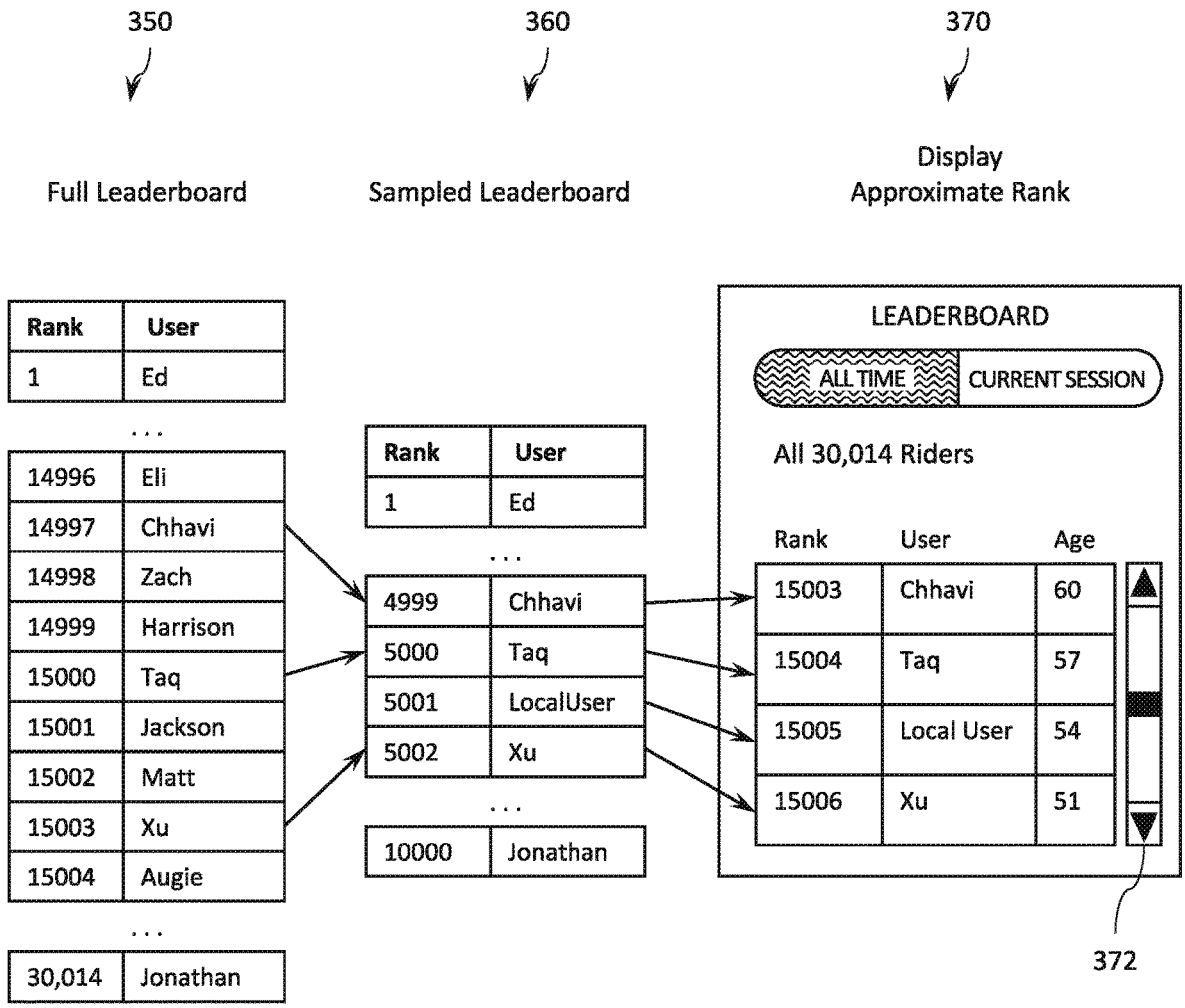
FIG. 3B illustrates an example data flow including a full leaderboard, a sampled leaderboard, and a displayed user rank, in accordance with one or more embodiments of the present disclosure.

In step 310, the local system displays comparative performance results for the user on a local display device. Referring to FIG. 3B, an example process for displaying an updated leaderboard during an exercise session will now be described in further detail. A full leaderboard 350 is downloaded from the leaderboard database/server for the exercise session to a distribution server or other server. As illustrated, the leaderboard ranks over thirty thousand class participants in this example. Although the full leaderboard 350 is illustrated as including a rank and user identifier, it will be appreciated that the full leaderboard (as well as the sampled leaderboard 360 and displayed leaderboard 370, may include other data associated with each participant, including workout performance data and metrics, gender, age, location, date of ride, etc.). A sampled leaderboard 360 reduces the leaderboard size to below a threshold level, including a subset of the previous class participants spanning the range of performance rankings. During operation, the sampled leaderboard 360 is downloaded to the local system and periodically sorted based on participant output metrics at a current time in the exercise session. It is noted that the sorting function may begin with the list in sorted order from the prior ranking and the update to the current rank will not typically change the rankings in a significant manner. Thus, the sorting is often performed efficiently on a substantially sorted list. The current users, including the local user (LocalUser) of the local system are included in the rankings. A leaderboard window 370 may be displayed to the local user allowing the local user to see an approximate ranking on the full leaderboard. The leaderboard window 370 may include one or more controls 372, such as a scroll bar, allowing the user to navigate the list. It will be appreciated that the systems and methods disclosed herein are scalable and efficient as compared, for example, to using a full leaderboard during an exercise session.

In one implementation, the server is implemented as a gRPC server, an open-source remote procedure call framework facilitating communications between client (e.g., local exercise system, media distribution server, etc.) and server applications. The server implements a LeaderboardService member to fulfill leaderboard requests. The LeaderboardService class creates and maintains a UserOutput for each ongoing workout. The UserOutput is responsible for sorting and retrieving the leaderboard at a given time. UserOutput uses a Leaderboard member which depends on compressed workout data used to extrapolate outputs for users in kilojoules. The LeaderboardService class creates and maintains a UserOutput for each ongoing workout.

The sampled leaderboard algorithm improves the leaderboard algorithm by reducing the time complexity from O(N*W) without sampling to O(N). By limiting the number of workouts allowed on the leaderboard, sampling the full leaderboard turns a variable problem into a fixed solution. Further, the system uses a rank approximation algorithm to estimate the full leaderboard rank from the sampled leaderboard. In one approach, the sampled data is selected at percentile steps allowing the approximate rank to be extrapolated from the sampled ranking. For example, if the sampling algorithm selects every $10^{th}$ rider from the full leaderboard, real rankings of 49990, 50000, and 50010 may translate into a sampled rank of 4,999, 5,000, and 5001, respectively. The ranking displayed in the leaderboard window may be similarly translated back into the full leaderboard. It is recognized that there may be some minor discrepancies in the displayed ranks compared to using the full leaderboard, however it is noted that the error percentage using the algorithms described herein was measured at less than 0.5% in test implementations and provides the user with a competitive experience that simulates the full leaderboard.

For example, by sampling 10,000 workouts based off of their final leaderboard percentile, an error percentage below 0.51% has been achieved. In other words, with an error percentage of 0.51%, in a class of 200,000 workouts the system can expect the approximated rank to be within 1000 of the actual rank. Because the workouts are sampled from the final leaderboard output, the error rate will continue to decrease until the end of the exercise session.

One drawback with the sampled leaderboard approaches is that the local system may not reproduce the closest competitors to the user on the full-sized leaderboard. For example, a user among the top 10 performers may not see a comparison with the other top 10 performers. Thus, the local user will not see each competitor that the user passes as the user moves up or down the leaderboard and the user's rank will be an approximation. Thus, in various embodiments, the system may still rely on the full-sized leaderboard for scenarios where system constraints are not an issue. For example, the full-sized leaderboard may be used to display a static leaderboard window (e.g., one that isn't updated during class) if desired, and may be used to populate a final leaderboard window after the user's workout. In some embodiments, the sampled leaderboard is used in-class when a user display is configured to show the leaderboard window. After the class ends, the bandwidth and processing constraints, latency issues and desire to create an optimal real-time competitive environment are less important to the overall user experience. The local user's all-time leaderboard rank in the workout history may then be updated on the full leaderboard to generate a final user rank. The user's all-time rank may be displayed by centering the current user on a list displayed on the user's window.

In various embodiments, the sampled leaderboard may be selected using other criteria to improve the experience for the user. For example, the sampled leaderboard may further include participants who are known to the user (e.g., based on the user's contacts) to provide familiar names on the displayed leaderboard. The sampling logic may further populate the sampled leaderboard with participants based on the user's projected performance to include similar riders in the performance results for more accurate competition during the exercise session. For example, for a user whose performance is projected to be in the top 50 performers a sampled leaderboard may include (or be supplemented with) the top 100 (or other number as desired) performers from the full leaderboard. Alternatively, the sampled leaderboard could include the top 10,000 performers (or other number up the threshold size) for top participants to provide a more accurate exercise experience.

Various embodiments for approximating the user's rank during an exercise session will now be described. One goal of the sampled leaderboard is to make the experience transparent to the user to preserve the experience of competing against the large all-time leaderboard. For example, ranks are approximated using the output of the workouts ranked above and below the active user. In one embodiment, the sampled leaderboard is constructed by sorting the all-time leaderboard by output and selecting every nth user, to create a sampled leaderboard up to a threshold size. For example, every $10^{th}$ user may be selected from an all-time leaderboard of 100,000 participants to generate a sampled leaderboard of 10,000 participants.

Figure 4:
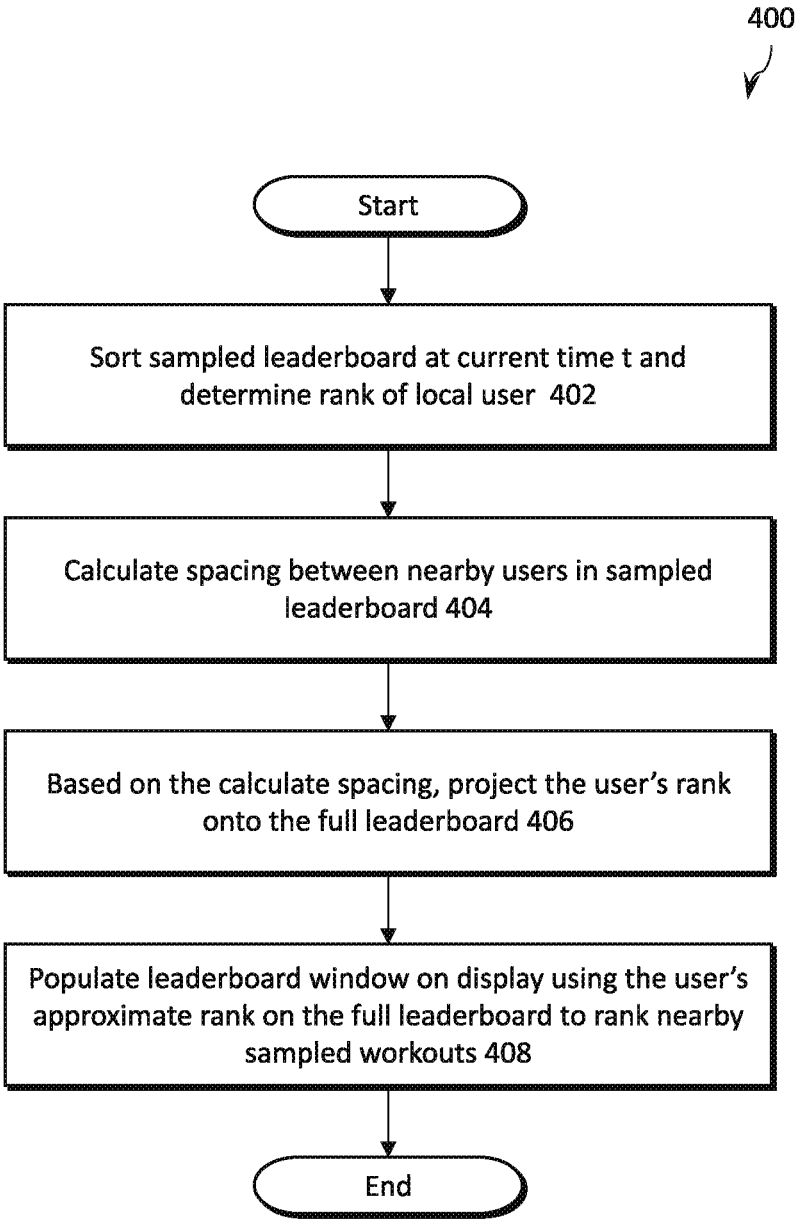
FIG. 4 illustrates an example method for determining a user's approximate rank on a leaderboard, in accordance with one or more embodiments of the present disclosure.

In operation, ranks can be approximated using the output of the workouts ranked above and below the active user. An example process 400 for determining an approximate rank from a sampled leaderboard is illustrated in FIG. 4, in accordance with one or more embodiments. First, in step 402, the sampled leaderboard is sorted based on the total performance output of each user for the current portion of the exercise session, and the current user's position in the sorted sampled leaderboard is determined. To illustrate a determination of approximate rank, the following variables (example values) will be used: All time leaderboard size (100,000), Sampled leaderboard size (10,000), User's current output (300 kJ), User rank in sampled leaderboard at time t (5,000), Output of rank 4999 at time t (310 kJ), and Output of rank 5,001 at time t (295 kJ).

Next, in step 404, the local system is configured to calculate the spacing between workouts nearby the current user based on the associated output values:

$$\frac{\text{output}_{rank-1} - \text{output}_{rank}}{\text{output}_{rank-1} - \text{output}_{rank+1}} = \text{spacing}$$

$$\frac{310\text{ kj} - 300\text{ kj}}{310\text{ kj} - 295\text{ kj}} = 0.666$$

Next, in step 406, the calculated spacing is used to project the user's rank onto the full all-time leaderboard as follows:

$$(\text{rank}_{sampled} + \text{spacing}) \times \left(\frac{\text{size}_{full}}{\text{size}_{sampled}}\right) = \text{rank}_{approx}$$

-continued $$(5{,}000 + 0.666) \times \left(\frac{100{,}000}{10{,}000}\right) = 50{,}006$$

In step 408, a leaderboard window is populated on the user's display using the user's approximate rank to rank the other sampled workouts to ensure the leaderboard maintains its large feel.

The leaderboard sampling algorithms discussed herein provide many advantages over conventional systems. For example, a conventional all-time leaderboard isn't scalable because when the user base doubles, the system will need 4 times the resources to support traffic. In other words, it is an $O(n^2)$ scaling problem. For example, 50,000 on-demand users may require 60 servers to produce a simulated live user experience. If there are 100,000 users the system may need 240 servers, and if there are 200,000 users, the system may need 960 servers. One goal is to maintain a full leaderboard while maintaining a scalable leaderboard size for use during operation in a manner that provides the user with a live competitive experience.

Compressed Leaderboard Systems and Methods

The growing popularity of live and archived exercise classes has led to increased demands on content server systems and data storage and retrieval systems to meet the real-time requirements of class participants. For example, a widely adopted exercise class content storage and delivery system may receive requests, on average, to produce leaderboard content for 5,000 to over 50,000 users at a time. The system may receive and process a plurality of data points associated with each class and each class participant. The average class in such systems could consume large amounts of storage space (e.g., over 10 megabytes of data) and larger classes may consume over 70 megabytes of storage in various systems. In some systems, a leaderboard delivery system may be designed to meet one or more performance goals including delivering over 50 new workouts per second with peak demand of over 150 workouts per second and being able to quickly load 1 GB or more of leaderboard information for the workouts. It is anticipated that the number of participants, the amount of data stored, and amount of content processed and delivered may increase beyond these requirements as systems continue to grow to accommodate more users and facilitate more features.

Figure 5:
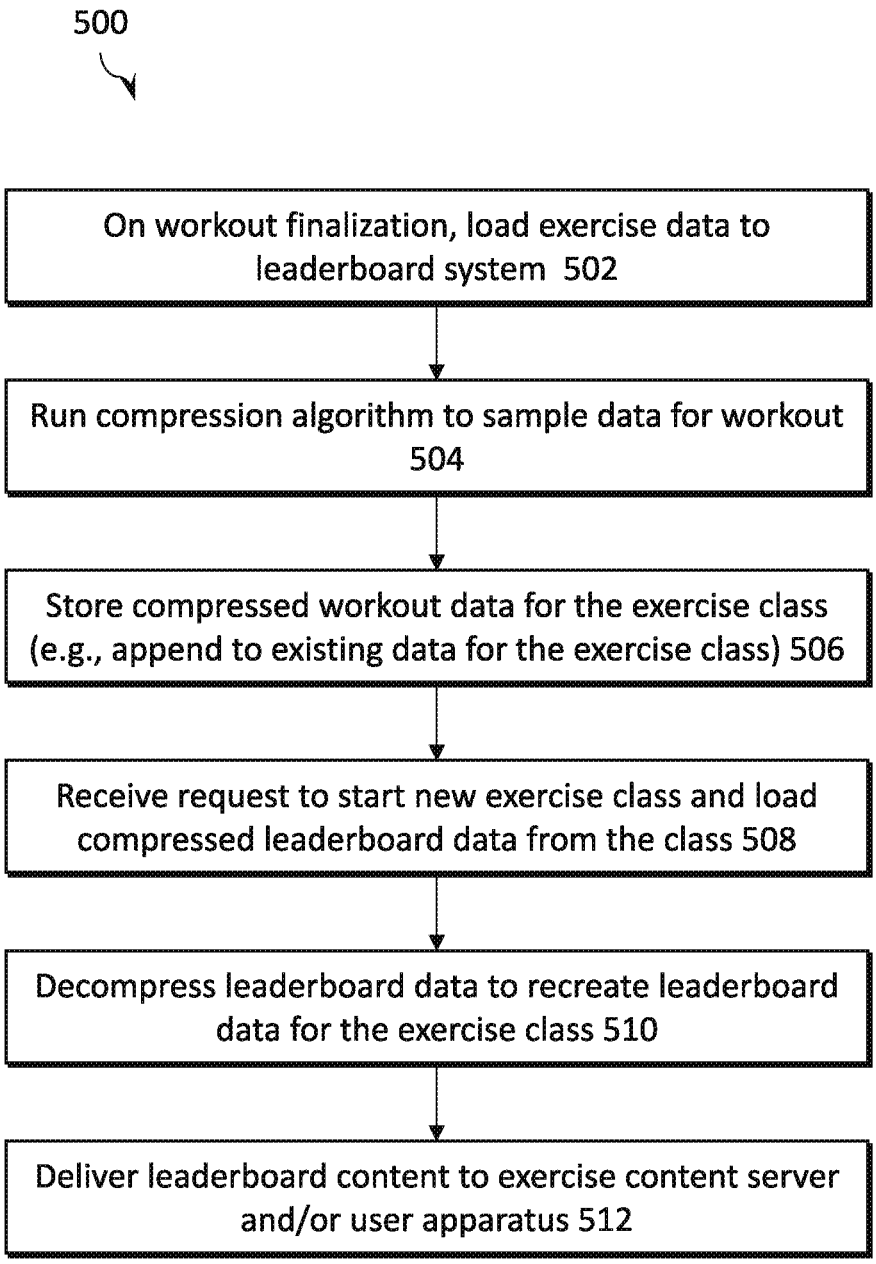
FIG. 5 illustrates an example method for operating a leaderboard system, in accordance with one or more embodiments of the present disclosure.

Various embodiments of an example compressed leaderboard system will now be described with reference to the figures. Referring to FIG. 5, a method 500 for operating a leaderboard system may be performed by one or more processing systems, such as one or more network servers or cloud application and storage servers (e.g., performed by any of the systems, and in conjunction with any of the methods, described herein with respect to FIGS. 1A-4 and FIGS. 6-14C). In some embodiments, one or more content servers are configured to facilitate live and/or on-demand exercise classes for users of an exercise apparatus. Exercise data may be processed for every workout (or a subset thereof), which may include uploading exercise data during or after each workout. In the illustrated embodiment, on workout finalization, such as the end of an exercise class, every packet or selected packets of data for a workout are uploaded to a leaderboard system (step 502). Next, the leaderboard system executes a compression algorithm to sample data points to reduce the data needed to recreate the workout later (step 504). The compressed workout data is then stored in a leaderboard storage (e.g., cloud storage, networked database storage, etc.) accessible to the leaderboard system (step 506). This may include creating a new leaderboard file for the exercise class, appending the compressed workout data to existing data for the exercise class, or other storage process.

When a user of an exercise apparatus starts a new on-demand exercise class, the data previously stored in the leaderboard storage system is identified and read from the leaderboard storage (step 508). The sampled data points are used to decompress the leaderboard to recreate a representation of the full leaderboard (step 510). The decompressed leaderboard content will then be provided to the content server serving media associated with the on-demand exercise class to the exercise apparatus and/or to another system or device associated with the exercise class (step 512). For example, in some embodiments the user of an exercise apparatus may access exercise content through a networked device such as a mobile phone, tablet, television, computer or other system that receives, displays and/or plays back the media associated with the on-demand exercise class. In some embodiments, the compressed leaderboard data is delivered to the client device, which is configured to decompress the leaderboard data as described herein.

In some embodiments, the compression uses a lossy compression algorithm, such as the Ramer-Douglas-Peucker algorithm ("Douglas-Peucker algorithm"), to sample key points from each user's workout. In some embodiments, the compression algorithm starts with the first and last points of the workout and finds a point that is furthest away from the line segment between the first and last point. If the point is closer than a predetermined threshold to the line segment, then any points not currently marked to be kept can be discarded without the simplified curve being worse than the threshold. If the point furthest from the line segment is greater than the threshold away from the line segment, then the point is kept. The algorithm then recursively calls itself with each line segment between the points until no new points are added. When recursion is complete, a new data set defining the workout is generated including the points that have been marked as kept and stored in a leaderboard storage.

When a request is received for an on-demand workout, the leaderboard system retrieves the compressed data and the compression algorithm can interpolate those points to recreate the selected workout. Depending on the threshold used during compression, the system can control maximum error according to system specifications and constraints. In test environments, with a threshold of 1 (defined as 1 joule) setting the maximal error at any given point, a compression rate of 95% was achieved.

In some embodiments, the leaderboard system is configured to generate two compressed sets of data for a workout. The first dataset includes times for each class participant. The second dataset includes outputs corresponding to those times. Both lists may be stored (e.g., in plain text, in a database, etc.) in a file that includes a workout identifier and compressed data including associated times and outputs.

In some embodiments, the server and storage system are configured to store one file per ride. An advantage of this approach is that the system will be able to retrieve over 5,000 concurrent requests per ride at the speed of the network interface. One disadvantage of this approach is that updating these files may require extra logic and programming in a system in which server objects are immutable. In some embodiments, the server and storage system include a cloud storage system and/or cloud application server.

Figure 6:
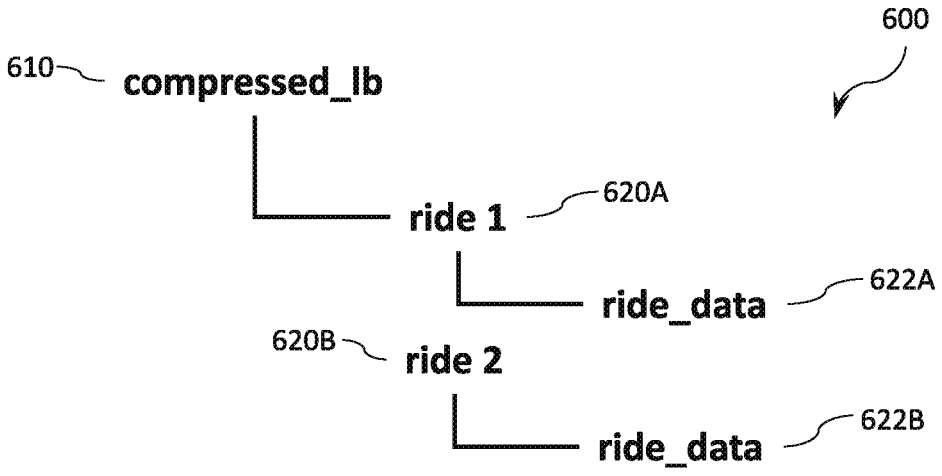
FIG. 6 illustrates an example file organization for storing leaderboard data, in accordance with one or more embodiments of the present disclosure.

An example file system 600 for used with a cloud storage system is illustrated in FIG. 6. The file system 600 may include a folder 610 for a compressed leaderboard data for an exercise class, and a prefix or "folder" per ride (e.g., ride1 620A and ride2 620B) with one file in each folder (e.g., ride_data 622A and ride_data 622B, respectively) which would have compressed data from the corresponding ride. In some embodiments, the ride prefix may be unnecessary, while in other embodiments the ride prefix may be used for certain cloud storage systems (e.g., S3) which guarantee a certain requests-per-second (RPS) performance on a prefix level. The folder 610 may include an exercise class identifier allowing the folder for a class to be readily identified.

Figure 7:
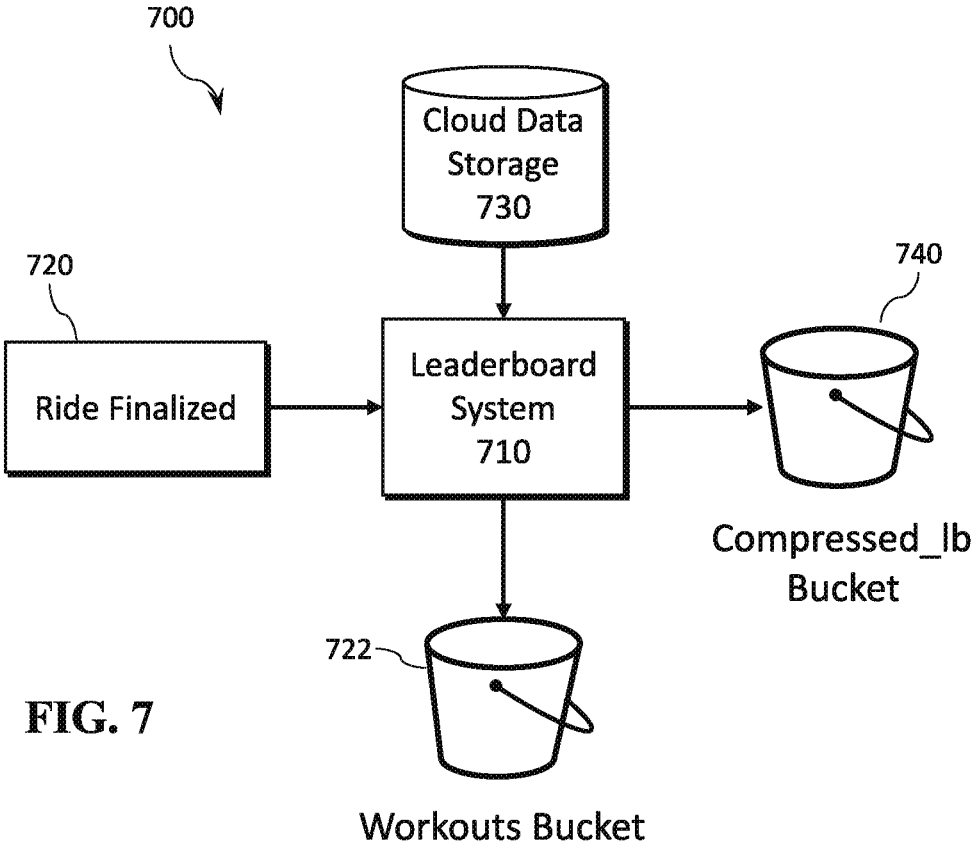
FIG. 7 illustrates an example system for generating an initial ride file, in accordance with one or more embodiments of the present disclosure.

The generation of the initial ride file will now be described with reference to FIG. 7. An exercise content storage and delivery system 700 serves media content for a live or on-demand ride and captures and stores workout data. When a ride is finalized (e.g., when a live ride ends and an "End Workout" Segment control button, for example, is pushed) a component 720 of the exercise content storage and delivery system 700 creates a ride identifier that be added to a queue of workouts 722 for processing. The generation of a ride identifier may be followed by a function initiated by the leaderboard system 710 to request leaderboard workout data from all of the user workout devices for the class. In some embodiments, multiple riders may participate in a class from various remote locations, and the leaderboard system 710 requests workout data associated with a corresponding exercise apparatus for each user/location. In some embodiments, the workout data is automatically uploaded by the local workout devices at the end of a workout session.

In various embodiments, the leaderboard system 710 may be implemented through a network server, cloud application server, an event-driven, serverless computing platform (e.g., AWS Lambda) providing web services or other computing environment. The system will load available workout data (e.g., received packets from an exercise device or cloud storage system) and any missing packets from other online storage systems (e.g., cloud storage 730) associated with the ride, to generate the compressed leaderboard 740. The compressed leaderboard may be stored to a cloud storage system in the compression format described above for subsequent retrieval of an on-demand exercise class. In some embodiments, the cloud storage 730 includes a relational or non-relational database (e.g., DynamoDB).

In some embodiments, the leaderboard system includes special logic allowing leaderboard data to be appended through using the file structure previously described. All rides may be added to a master ride file on the cloud storage, so that on-demand workouts appear in future leaderboards. By using an append operation, only the data appended will get uploaded, thereby saving on network bandwidth usage, processing and costs. Other system structures may also be used, but many have constraints that include databases (difficult to meet needed QPS) and EFS (too costly in view of expected throughput and high variance in latency) which could negatively affect user experience.

Figure 8:
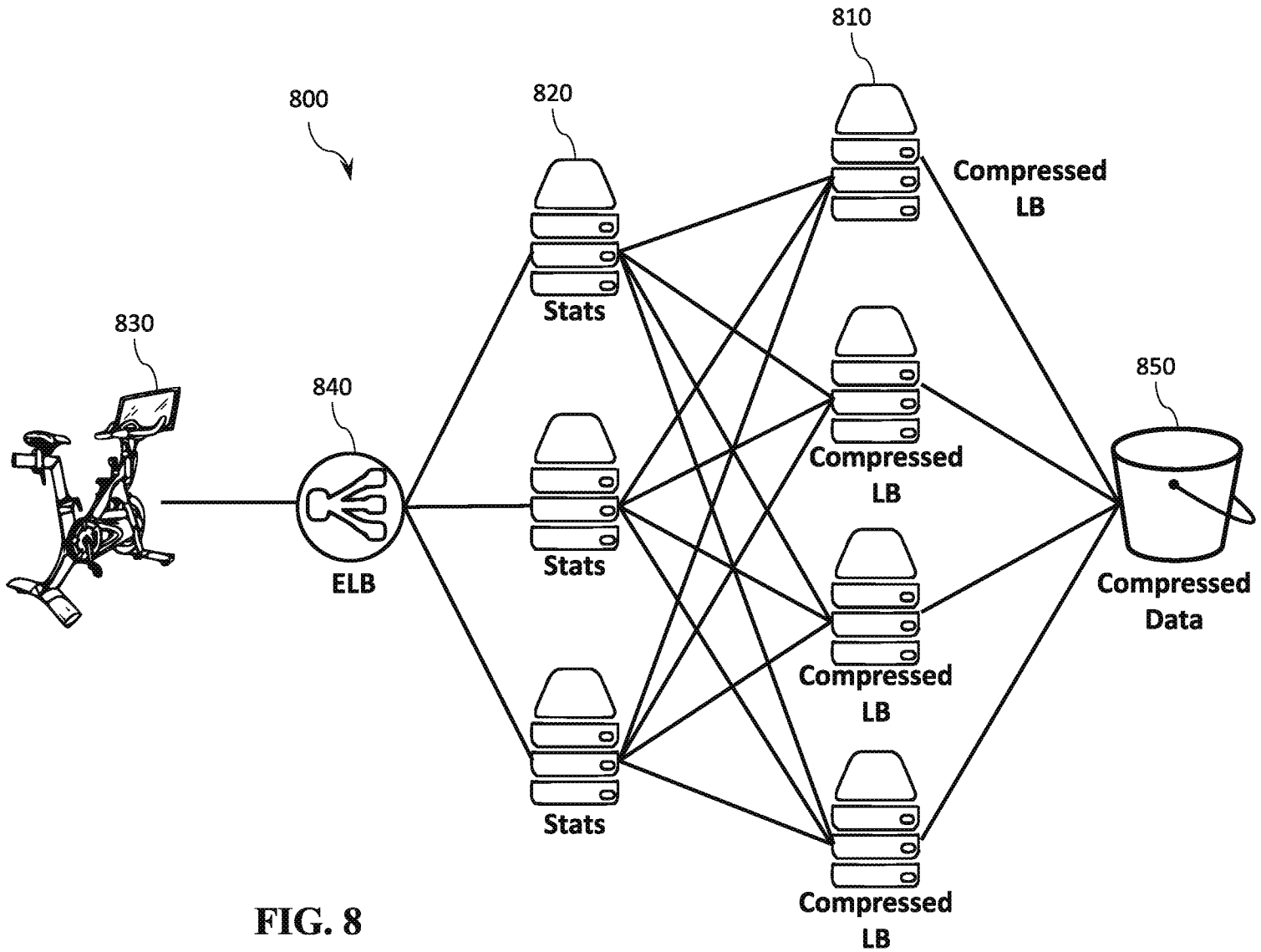
FIG. 8 illustrates a first example leaderboard system for generating, compressing and storing leaderboard data, in accordance with one or more embodiments of the present disclosure.

An embodiment of a system 800 for implementing a leaderboard server is illustrated in FIG. 8. The system 800 includes a plurality of servers, processing devices, routing devices, and storage devices in a networked arrangement. A server is the component that will read the compressed data from storage (e.g., cloud storage) and recreate the leaderboard. Compressed leaderboard servers 810 are configured to execute leaderboard compression and server logic. The compressed leaderboard servers 810 receive requests from one or more statistics servers 820 that may include adding a user to a leaderboard, returning the full leaderboard, and other related commands.

When the system 800 gets receives a request to start a workout (e.g., an exercise class having a ride identifier), an associated request for leaderboard information is passed to a compressed leaderboard server 810, which is configured to find the correct file for the ride identifier from a workout database of compressed data 850. The compressed leaderboard server 810 then loads the full leaderboard from the stored compressed data 850. At this point the leaderboard may be embodied as a compressed list of lists. The compressed leaderboard server 810 then processes these lists to create a list of functions (e.g., polynomial functions) which can be called with a timestamp to return an output for that timestamp (e.g., using a linear interpolator library). For "add" requests, the compressed leaderboard server 810 compresses and stores the user's latest output received from an exercise apparatus 830. On subsequent "get" requests, the leaderboard server may loop over the list and recreate a full leaderboard for the user which it will then include the user output stored above.

To facilitate efficient processing, the system 800, in some embodiments, is configured to efficiently route (e.g., via elastic load balancing routers 840) a given workout to the same server. For example, this can be accomplished by sharding on workout ids in the stats server 820. In the event of a server crash, the leaderboard can be served from any server, with an adjustment of the routing. Some latency may be experienced during the switchover because the new server will reread the leaderboard from the cloud storage system.

Figure 9:
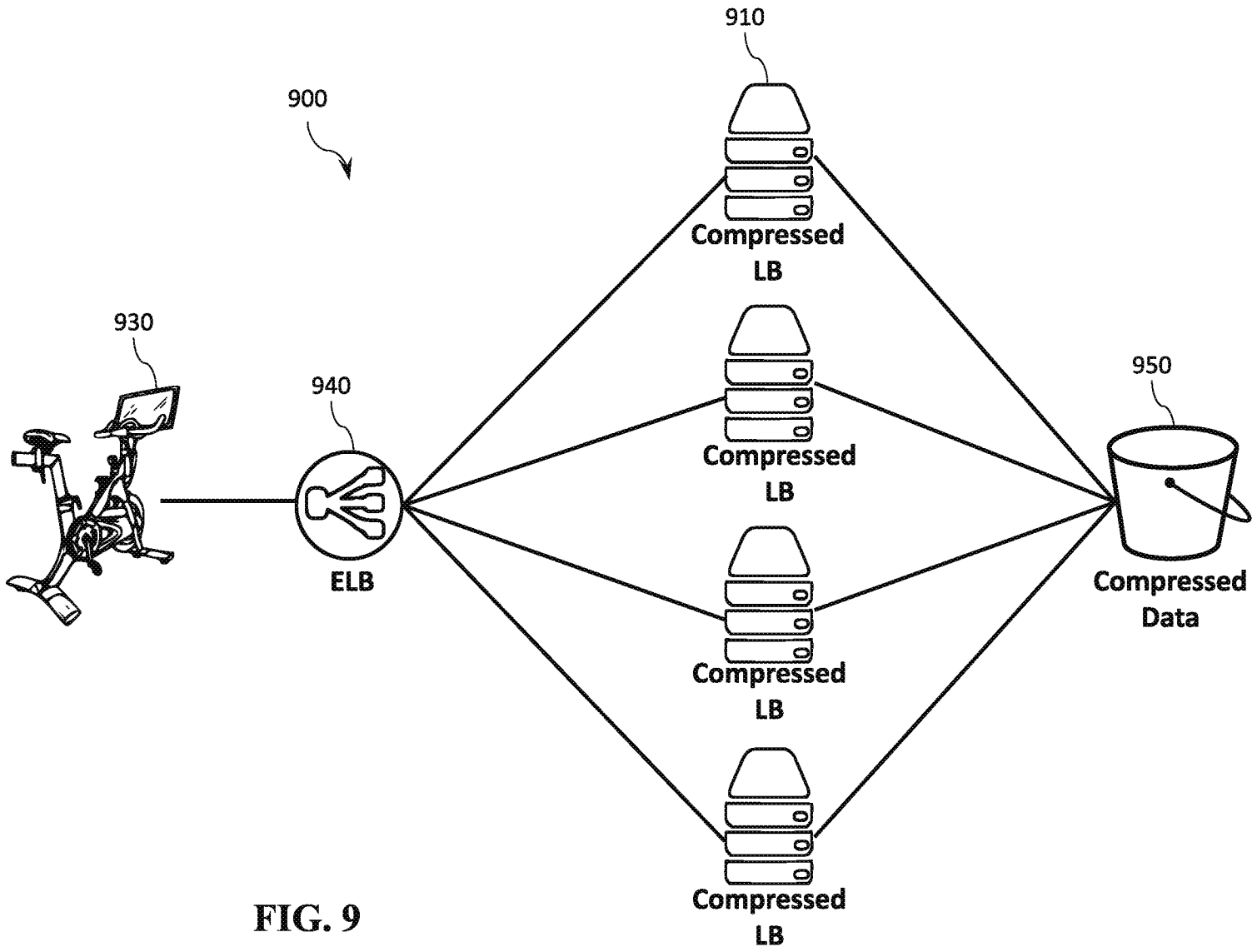
FIG. 9 illustrates a second example leaderboard system for generating, compressing and storing leaderboard data, in accordance with one or more embodiments of the present disclosure.

Another embodiment of a system 900 for implementing a leaderboard server is illustrated in FIG. 9. One goal of this embodiment is to route (e.g., via clastic load balancing routers 940) on-demand leaderboard requests from an exercise apparatus 930 directly to the compressed leaderboard server 910, which interfaces with the compressed data storage system 950. In order to accomplish this, the compressed leaderboard server 910 includes logic to facilitate sorting, filtering and windowing the data. Without a statistics server doing the routing, the ELB layer 940 is configured to handle the routing using sticky sessions.

The logic for implementing the compressed leaderboard services may be written in Kotlin, Python or other suitable programming language for execution by a processor. In some embodiments, Kotlin would reduce the complexity of the service as compared to Python. The system may be programmed to have several independent processes, one per core. There are several considerations to be addressed with this, two of which are lack of shared memory and routing complexity. In some embodiments, with a remote procedural call layer between the client process and the leaderboard processes, in order to have balanced load distribution every client would be connected to every single process running which would multiply with the number of cores. This system may also need every request for the same workout to go to the same process because there is a cost to loading the compressed leaderboard or to share memory between them with a third-party piece of software (e.g., a distributed memory caching system), which is not as efficient as storing every request in random access memory or other fast access memory in a lock free data structure. The system may lose the ability for workouts to share decompressed through an in-process memory structure. Then the networking complexity would grow with the number of cores.

In other embodiments, Python processes may be used, which may affect efficiency. With the leaderboard data stored for a workout consistently in one process standard Python libraries pose issues because they may close processes after finishing running tasks and respawn new ones for new tasks. To achieve a goal of generating a new leaderboard every 2 seconds or better, the system may either have to reallocate a new array every time or store the previous second's leaderboard, but that would be copied into the new process's memory space when spawned. Either way the process would either be doing a lot of copying or a lot of allocating.

In some embodiments, a programming language such as Kotlin, which is written over the Java Virtual Machine and has native multithreading built in, may be used. Kotlin can avoid certain work-arounds to a global interpreter lock or spawning processes with a copy on write memory model. Kotlin allows the system to have a shared object for the decompressed leaderboard for a ride. The system would then be able to generate second by second leaderboards on a per workout basis in different threads without having multiple copies of the core leaderboard from the cloud. The system would also be able to store sorted leaderboards from previous requests and then generate new ones based on the previous seconds ordering. Because users don't move that much the system will be creating mostly sorted leaderboards in place, completely avoiding copying and optimizing the subsequent sort because the data will be close to sorted because people don't tend to move around too much every second.

Example Compressed Leaderboard Implementations for Exercise Apparatus

Figure 10:
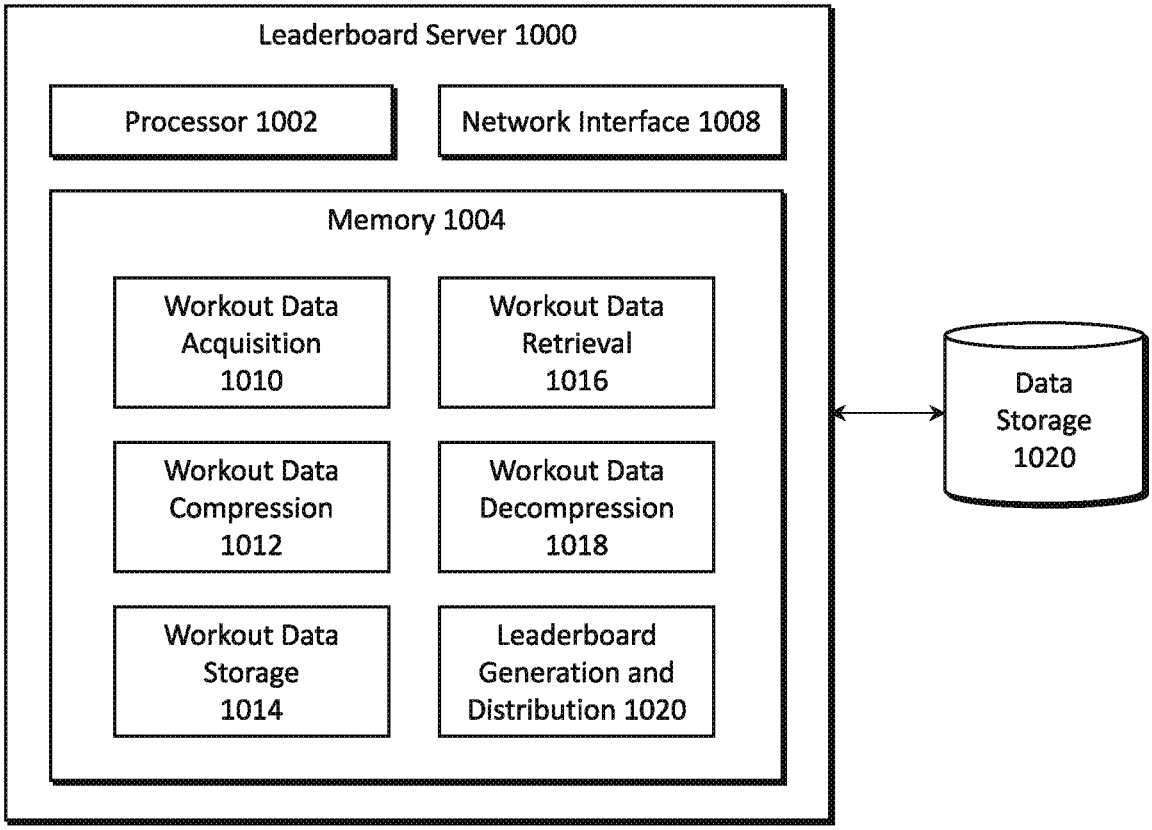
FIG. 10 illustrates an example leaderboard server, in accordance with one or more embodiments of the present disclosure.

The systems and methods disclosed herein can be embodied in a server environment that operates via the Internet or another network such as a wireless network. An example leaderboard server 1000, in accordance with one or more embodiments of the present disclosure is illustrated in FIG. 10. The leaderboard server 1000 may include one or more processors 1002, memories 1004, network interfaces 1008, and a data storage 1020 (e.g., cloud storage, networked storage, etc.). The processor 1002, may include any suitable processing component or logic device such as a central processing unit, a multi-purpose processor, a microprocessor, a special purpose processor, etc. The memory 1004 may include one or more volatile, non-volatile, and/or replaceable storage components, such as magnetic, flash, optical or other storage components. The memory 1004 may store computer-readable instructions and logic stored 1004 for execution by the processor 1002, including various logical components and processes as disclosed herein. In some the embodiments, the leaderboard server 1000 includes software modules configured to facilitate workout data acquisition 1010, workout data compression 1012, workout data storage 1014, workout data retrieval 1016, workout data decompression 1018, leaderboard generation and distribution 1020. The network interface 1008 is configured to facilitate communications between the leaderboard server 1000 and other systems or devices via a communications network that may include wired (e.g., Ethernet), wireless (e.g., cellular, WI-FI), and/or other networking types configured for efficient data transfer communications.

Figure 11A:
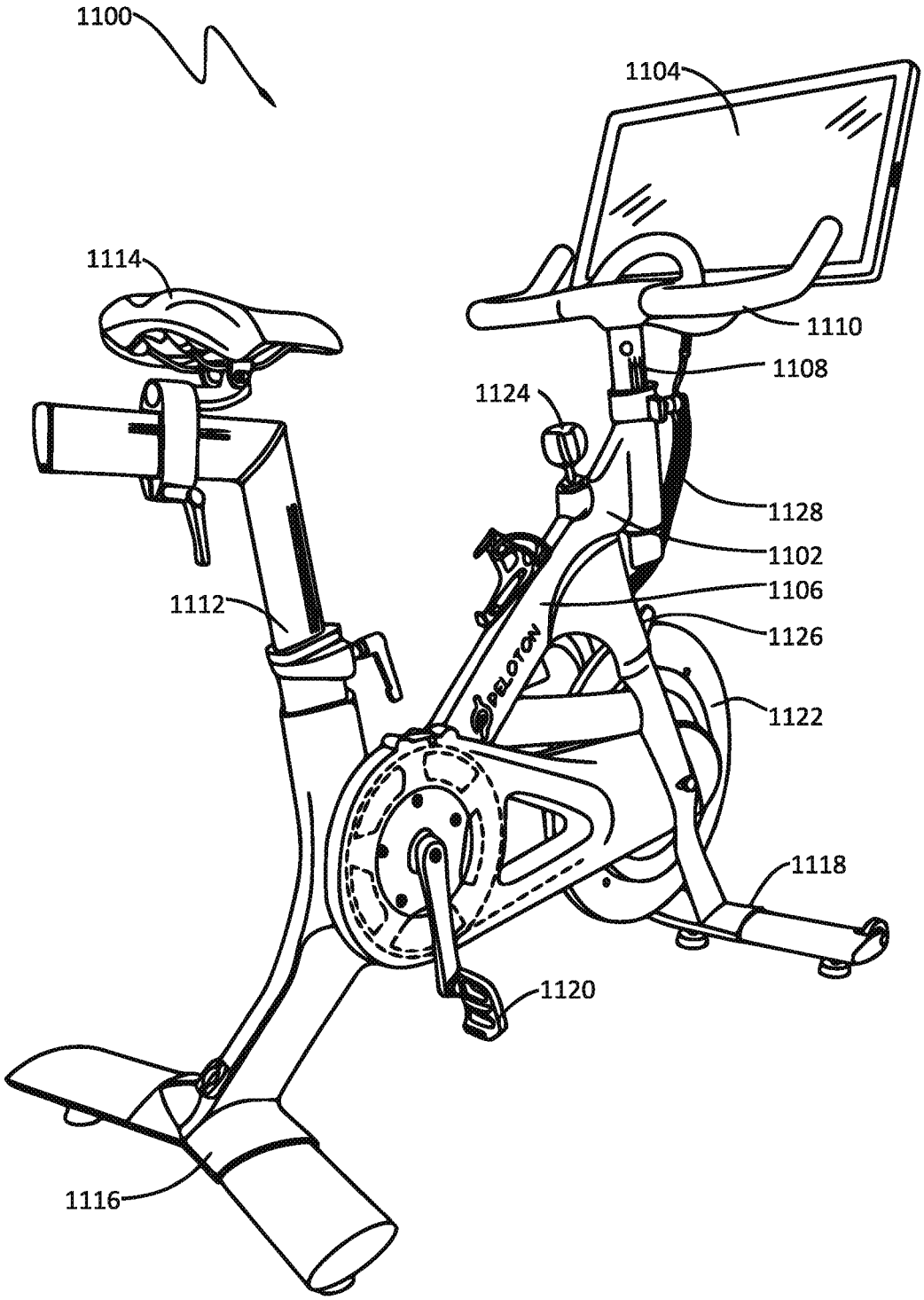
FIGS. 11A and 11B are rear perspective views of an example local exercise apparatus, in accordance with one or more embodiments the present disclosure.
Figure 11B:
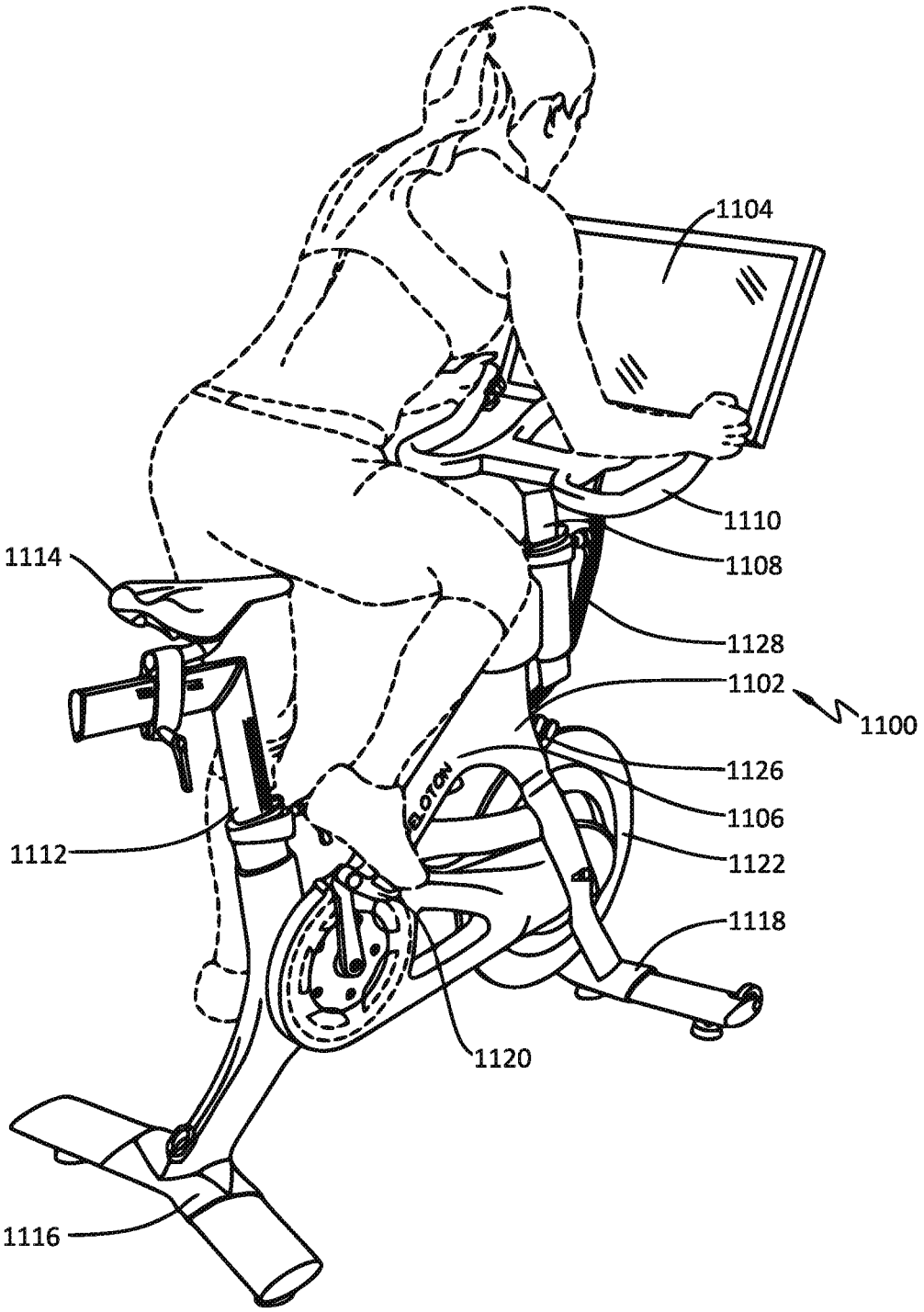

Referring generally to FIGS. 11A and 11B, various embodiments of an exercise apparatus will now be described. Although the embodiments illustrate an example with a stationary bike, exercise classes and other exercise related content, it will be appreciated that the present disclosure is not limited to cycling and may be implemented with other exercise equipment and/or other content creation and delivery applications.

In various embodiments, local system 1100 comprises a stationary bike 1102 with integrated or communicably connected digital hardware including at least one display screen 1104. The stationary bike 1102 may comprise a frame 1106, a handlebar post 1108 to support the handlebars 1110, a seat post 1112 to support the seat 1114, a rear support 1116 and a front support 1118. Pedals 1120 are used to drive a wheel 1122 via a belt, chain, or other drive mechanism. The wheel 1122 may be a heavy metal disc or other appropriate mechanism. In various example embodiments, the force on the pedals necessary to spin the wheel 1122 can be adjusted using a resistance adjustment knob 1124. The resistance adjustment knob or other resistance adjustment components may directly or indirectly control a device that increases or decreases the resistance of the wheel to rotation. For example, rotating the resistance adjustment knob clockwise may cause a set of magnets 1126 to move relative to the wheel, increasing its resistance to rotation and increasing the force that the user must apply to the pedals to make the wheel spin.

The stationary bike 1102 may also include various features that allow for adjustment of the position of the seat 1114, handlebars 1110, etc. In various example embodiments, the display screen 1104 may be mounted in front of the user, forward of the handlebars. Such display screen may include a hinge or other mechanism to allow for adjustment of the position or orientation of the display screen relative to the rider. In some embodiments, the display screen may be implemented in a tablet, mobile phone, portable computer, television or other device communicably connected to one or more components of the stationary bike 1102.

The digital hardware associated with the stationary bike 1102 may be connected to or integrated with the stationary bike 1102, or it may be located remotely and wirelessly connected to the stationary bike. The display screen 1104 may be attached to the stationary bike or it may be mounted separately but should be positioned to be in the line of sight of a person using the stationary bike. The digital hardware may include digital storage, processing, and communications hardware, software, and/or one or more media input/output devices such as display screens, cameras, microphones, keyboards, touchscreens, headsets, and/or audio speakers. In various example embodiments these components may be integrated with the stationary bike. All communications between and among such components may be multichannel, multi-directional, and wireless or wired (e.g., using a wire 1128), using any appropriate protocol or technology. In various example embodiments, the system may include associated mobile and web-based application programs that provide access to account, performance, and other relevant information to users from local or remote personal computers, laptops, mobile devices, or any other digital device.

In various example embodiments, the stationary bike 1102 may be equipped with various sensors that can measure a range of performance metrics from both the stationary bike and the rider, instantaneously and/or over time. For example, the stationary bike may include power measurement sensors such as magnetic resistance power measurement sensors or an eddy current power monitoring system that provides continuous power measurement during use. The stationary bike may also include a wide range of other sensors to measure speed, pedal cadence, wheel rotational speed, etc. The stationary bike may also include sensors to measure rider heart-rate, respiration, hydration, or any other physical characteristic. Such sensors may communicate with storage and processing systems on the bike, nearby, or at a remote location, using wired or wireless connections.

Hardware and software within the sensors or in a separate package may be provided to calculate and store a wide range of performance information. Relevant performance metrics that may be measured or calculated include distance, speed, resistance, power, total work, pedal cadence, heart rate, respiration, hydration, calorie burn, and/or any custom performance scores that may be developed. Where appropriate, such performance metrics can be calculated as current/instantaneous values, maximum, minimum, average, or total over time, or using any other statistical analysis. Trends can also be determined, stored, and displayed to the user, the instructor, and/or other users. A user interface may provide for the user to control the language, units, and other characteristics for the various information displayed.

In various example embodiments the stationary bike 1102 may be equipped with one or more large display screens (e.g., display screen 1104), cameras, microphones, and speakers or other audio outputs. The display screen 1104 may be mounted directly to the stationary bike 1102 or otherwise placed within the viewing area of the user. In various example embodiments, at least one display screen is integrated into or attached to the stationary bike and is positioned in front of the rider generally centered on the handlebars 1110 of the stationary bike as illustrated in the figures. Various mechanisms can be used to allow the user to customize the position of the display screen(s).

In an example embodiment, a display screen 1104 may be attached to the stationary bike 1102 via a curved structure extending up and forward from the front stem of the frame 1106. The curved structure may include a slot or aperture through it and extending along a portion of the length of the curved structure. A mounting post or similar structure on the display screen may attach to the curved structure, such as by a pin that passes through the mounting post or structure and the curved structure. In an example embodiment, the pin may have a mechanism such as threads that allow it to be tightened to hold and lock the mounting post or structure at a particular location and position.

Display screen 1104 may be driven by a user input device such as a touchscreen, mouse, or other device. In various example embodiments a touchscreen display is mounted on the stationary bike generally centered between the handlebars and located just below the handlebars. The display screen may be any size, but optimally is large enough and oriented to allow the display of a range of information including one or more video streams, a range of performance metrics for the user and others, and a range of different controls.

In various example embodiments the user can use a touchscreen or other interface to selectively present a range of different information on the screen including live and/or archived video, performance data, and other user and system information. The user interface can provide a wide range of control and informational windows that can be accessed and removed individually and/or as a group by a click, touch, or gesture. In various example embodiments, such windows may provide information about the user's own performance and/or the performance of other participants in the same class both past and present.

The user interface can be used to access member information, login and logout of the system, access live content such as live exercise classes and archived content (referred to in the Figures as "Rides on Demand"). User information may be displayed in a variety of formats and may include historical and current performance and account information, social networking links and information, achievements, etc. The user interface can also be used to access the system to update profile or member information, manage account settings such as information sharing, and control device settings.

Figure 12A:
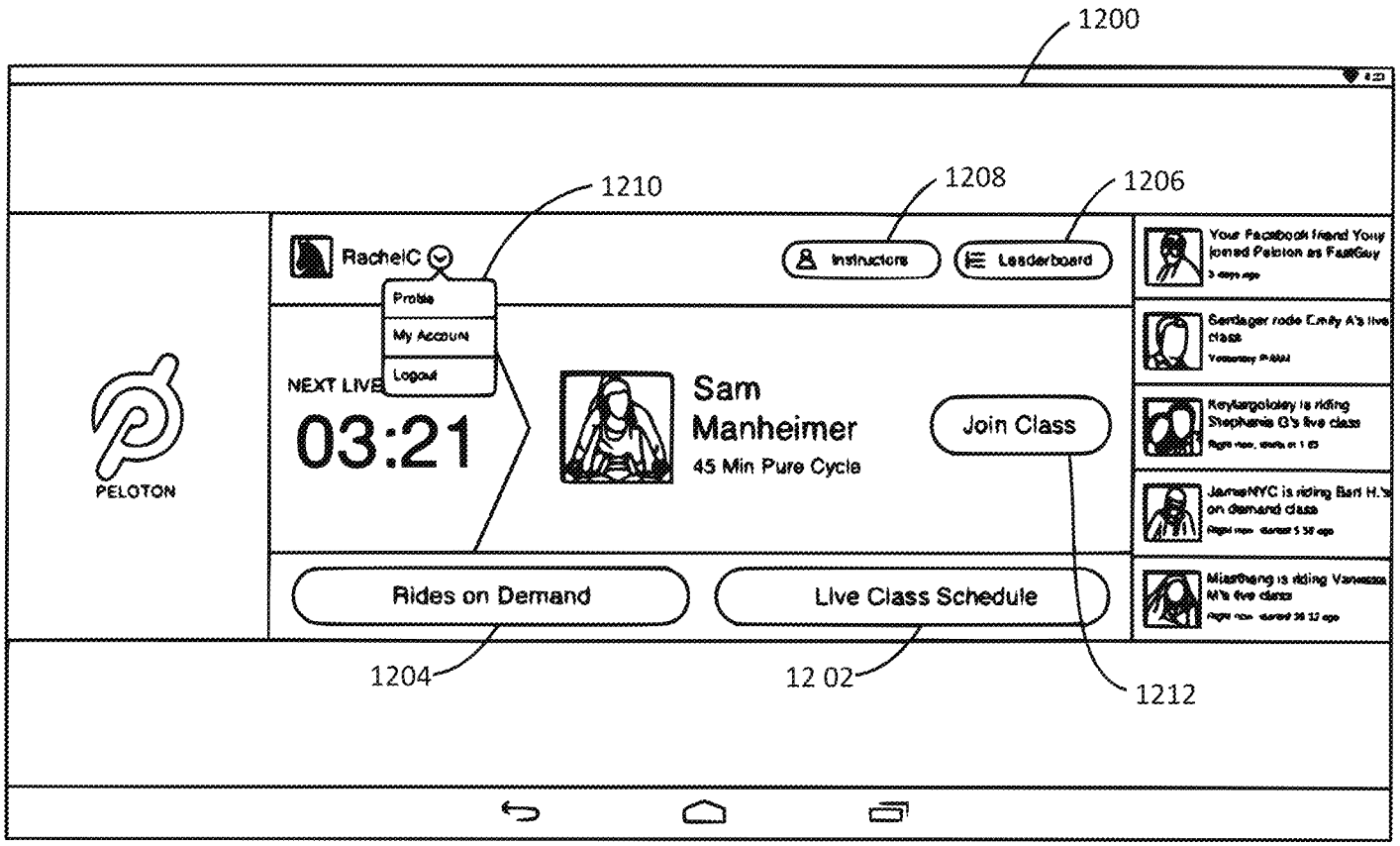
FIGS. 12A, 12B and 12C illustrate example user interface screens for a local exercise apparatus in accordance with one or more embodiments of the present disclosure.
Figure 12B:
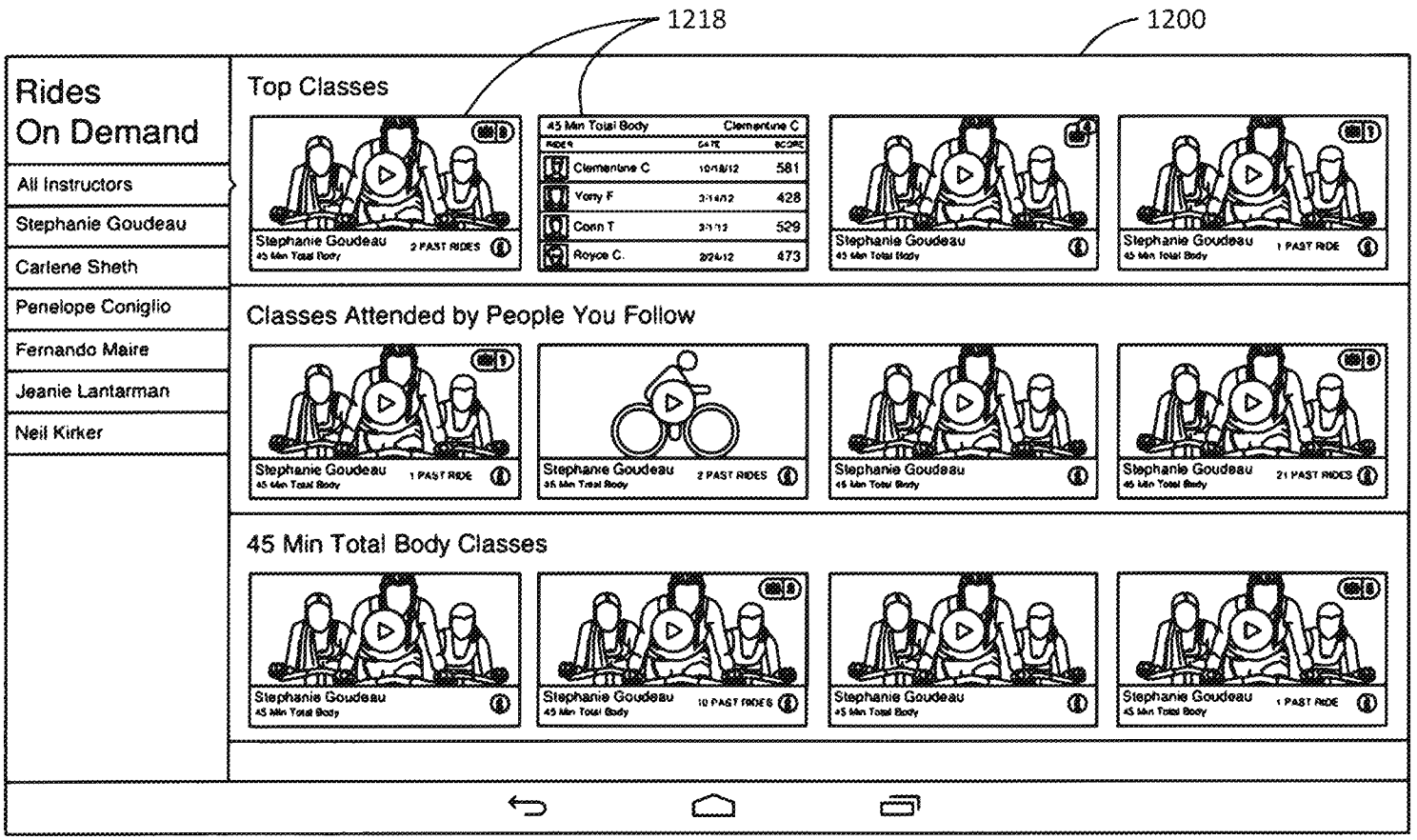
Figure 12C:
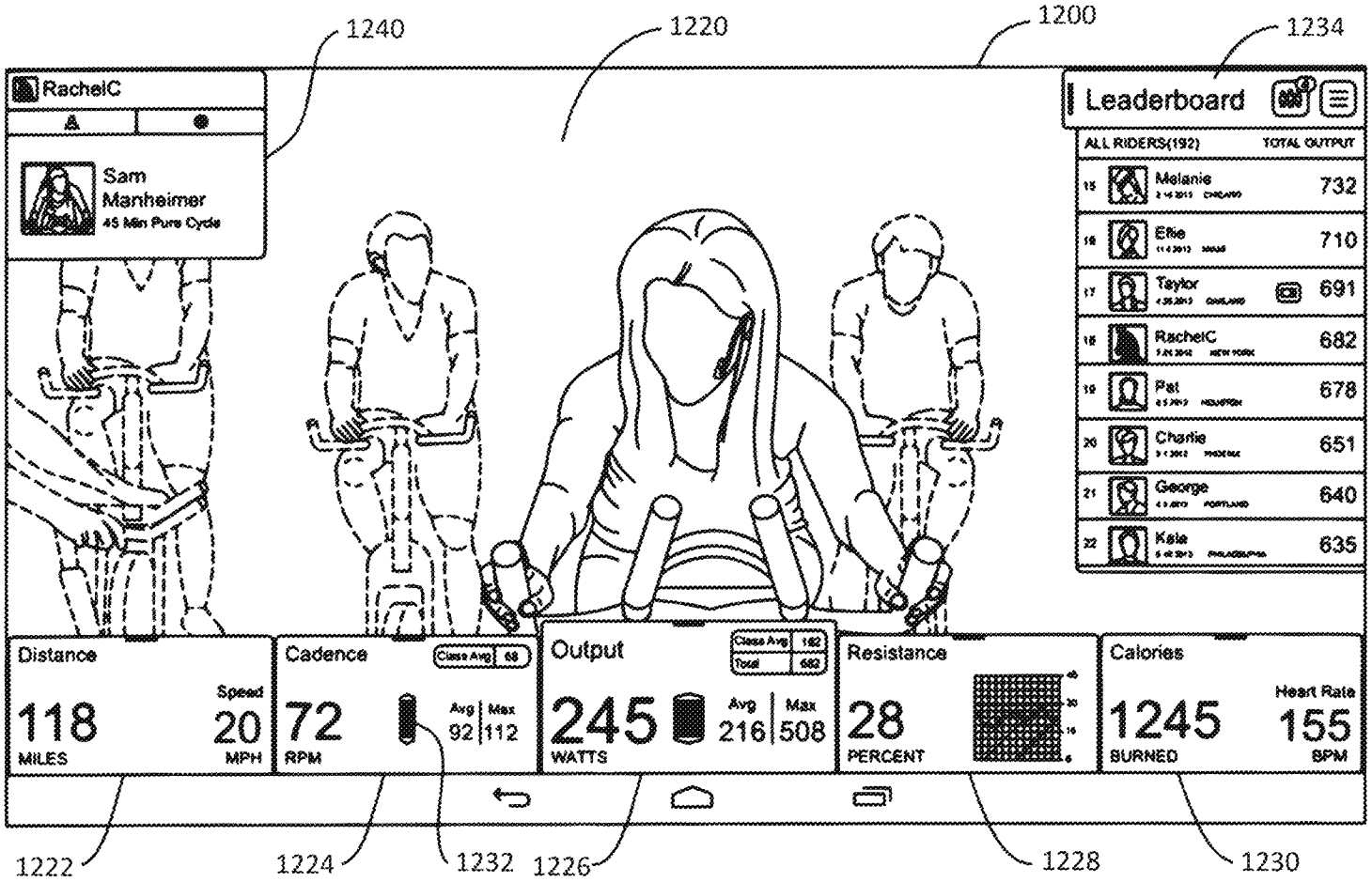

Referring to FIGS. 12A-12C, a user interface 1200 may be presented on the display screen 1104 to allow the user to manage their experience, including selecting information to be displayed and arranging how such information is displayed on their system. The user interface may present multiple types of information overlaid such that different types of information can be selected or deselected easily by the user. For example, performance information may be displayed over video content using translucent or partially transparent elements so the video behind the information elements can be seen together with the information itself.

The user interface 1200 may present a variety of screens to the user, which the user can move among quickly using the provided user input device, including by touching if a touchscreen is used. In various example embodiments, the user interface may provide a home screen that provides basic information about the system and available options. Referring to FIG. 12A, such a home screen may provide direct links to information such as scheduled classes 1202, archived classes 1204, a leaderboard 1206, instructors 1208, and/or profile and account information 1210. The screen may also provide direct links to content such as a link to join a particular class 1212. The user can navigate among the different screens in the user interface by selecting such links using the applicable input device such as by touching the touchscreen at the indicated location, or by swiping to bring on a new screen. The user interface may also provide other information relevant to the user such as social network information, and navigation buttons that allow the user to move quickly among the different screens in the user interface.

In various example embodiments, the user can select among both live and archived content. For example, if the user selects scheduled classes 1202, they may be presented with a screen showing the schedule of upcoming classes. The user interface allows users to select classes by time, instructor or rides type and/to start a class that is underway or about to begin. The class schedule may be presented in any suitable format, including calendar, list, or any other appropriate layout.

In various example embodiments, if the user selects archived classes 1204, they may be presented with a screen showing available archived classes sorted by any appropriate category. FIG. 12B shows an example display of archived classes that may be presented, for example, on any display as discussed herein (e.g., as discussed with reference to FIGS. 1A, 1B, 3A, 3B, 4, 8, 9, 11A, and 11B). Thumbnails or icons 1218 representing archived classes may be displayed in any suitable format and may include information on how many times the user has ridden that class in the past or other performance or class-related information. A class may be accessed by selecting a particular thumbnail or icon.

Referring to FIG. 12C, when a class is being playing on the display screen through the user interface 1200, in various example embodiments the primary video feed may be shown as the background video full-screen or in a sub-window on the screen. Information elements may be provided on different parts of the display screen to indicate any performance metrics, including time ridden, elapsed time, time left, distance, speed, resistance, power, total work, pedal cadence, heart rate, respiration, hydration, calorie burn, and/or any custom performance scores that may be developed. The displayed information may also include the trend or relationship between different performance metrics. For example, the display can indicate a particular metric in a color that indicates current performance compared to average performance for a class or over time, such as red to indicate that current performance is below average or green to indicate above average performance. Trends or relative performance can also be shown using color and graphics, such as a red down arrow to show that current performance is below average.

A primary window 1220 showing the live or archived class that the user selected. In various example embodiments, performance metric windows 1222, 1224, 1226, 1228, and 1230 may show specific performance metrics for the user's current ride, past rides, or other performance information. Such performance metric windows may be presented anywhere on the display screen and may be user selectable such that they can be displayed or removed by a screen touch or gesture. As shown in FIG. 12C, window 1222 displays distance and speed. Window 1224 displays current pedal cadence, along with the user's average and maximum cadence and the class average, and an indicator arrow 1232 showing whether the user's cadence is increasing or decreasing. Window 1226 shows power output in watts, together with average output, maximum output, class average, and total output, along with a similar indicator arrow. Window 1228 shows resistance as both a number and graphically, and window 1230 shows calories burned and heart rate.

The user interface may allow the user to toggle between display of maximum, average, and total results for different performance metrics. The user interface may also allow the user to hide or display information elements, including performance metrics, video streams, user information, etc. all at once or individually. Performance information can also be displayed in various display bars that can be hidden or displayed as a group or individually. The user interface may provide for complete controls for audio volume, inputs, and outputs as well as display output characteristics.

A leaderboard 1234 may also be displayed to allow the user to see their performance in comparison to others taking the same class. In various example embodiments, a leaderboard may be configured to display the relative performance of all riders, or one or more subgroups of riders. For example, the user may be able to select a leaderboard that shows the performance of riders in a particular age group, male riders, female riders, male riders in a particular age group, riders in a particular geographic area, etc. Users may be provided with the ability to deselect the leaderboard entirely and remove it from the screen. In various example embodiments, the system may incorporate various social networking aspects such as allowing the user to follow other riders, or to create groups or circles of riders. User lists and information may be accessed, sorted, filtered, and used in a wide range of different ways. For example, other users can be sorted, grouped and/or classified based on any characteristic including personal information such as age, gender, weight, or based on performance such as current power output, speed, or a custom score.

The leaderboard 1234 may be fully interactive, allowing the user to scroll up and down through the rider rankings, and to select a rider to access their detailed performance data, create a connection such as choosing to follow that rider, or establish direct communication such as through an audio and/or video connection. The leaderboard may also display the user's personal best performance in the same or a comparable class, to allow the user to compare their current performance to their previous personal best. The leaderboard may also highlight certain riders, such as those that the user follows, or provide other visual cues to indicate a connection or provide other information about a particular entry on the leaderboard. In various example embodiments, the leaderboard will also allow the user to view their position and performance information at all times while scrolling through the leaderboard.

In various example embodiments, the system calculates and displays one or more custom scores to describe one or more aspects of the users' performance. One example of such a custom score would be a decimal number calculated for a particular class or user session. Such a score could also be calculated using performance data from some or all classes or sessions over a particular period of time. In an example embodiment, the custom score takes into account the amount of time ridden, total work during that time period, and number of classes in a given time period.

In various example embodiments, performance information about other users may be presented on the leaderboard 1234 or in any other format, including formats that can be sorted by relevant performance parameters. Users may elect whether or not to make their performance available to all users, select users, and/or instructors, or to maintain it as private so that no one else can view it.

In various example embodiments the user interface may also present one or more video streams from a range of different sources. For example, one video stream may be the live or archived class content shown in the primary window, while one or more additional video streams may be displayed in other windows on the screen display 1104. The various video streams may include live or recorded streaming instructor video or any other video content, including one or more live video chat streams.

The user interface may also provide additional windows that can be used to display a range of content including additional performance data, information about the class, instructor, other riders, etc., or secondary video streams. Such additional windows can allow the user to see a range of information regarding other current or past participants to compare performance, and open or close voice or video chat streams or other communication channels. In various example embodiments the user can simultaneously access other content including movies, television channels, online channels, etc. A secondary window 1240 may display a range of information and content. In the illustrated embodiment, secondary window 1240 displays the name of the user, the name of the current class and basic class information, but other information may be displayed, such as information displayed in windows 1222, 1224, 1226, 1228 and 1230.

In various example embodiments, the system can provide for simultaneous participation by multiple users in a recorded class, synchronized by the system and allowing access to all of the same communication and data sharing features that are available for a live class. With such a feature, the riders simultaneously participating in the same archived class can compete against each other, as well as against past performances or "ghost" riders for the same class.

Figure 13:
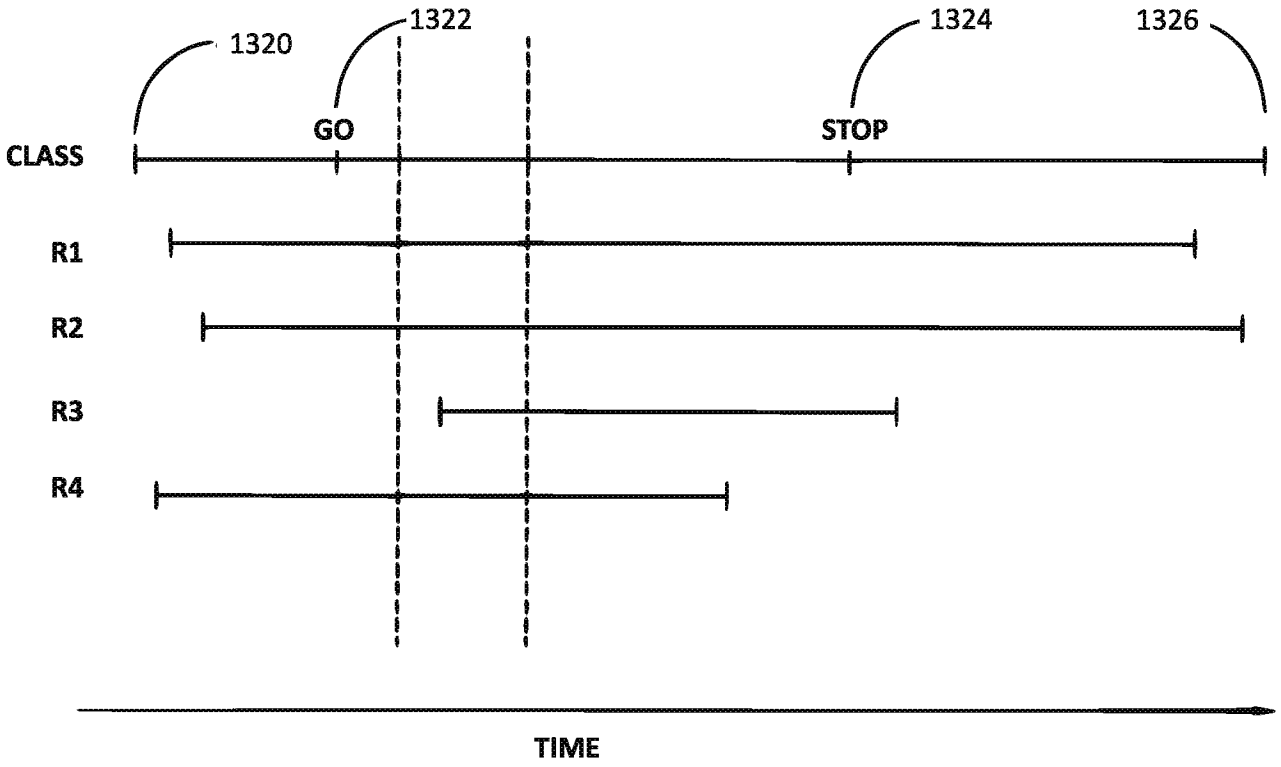
FIG. 13 is a chart showing an example method for synchronizing data among users participating in the same live or on-demand cycling class, in accordance with an embodiment of the present disclosure.

FIG. 13 shows various events relative to time, which is increasing from left to right on the scale at the bottom. The timeline for the class itself, whether live or archived, is shown at the top, with timelines for four different riders below it. The video being delivered for a live or archived class may begin before the actual class starts at the video start point 1320. The GO signal point 1322 indicates the start of the class or the class's comparison period, the STOP signal point 1324 indicates the end of the class or the end of the class's comparison period, and the end video point 1326 indicates the end of the video stream. For Riders 1, 2, and 4, who all start riding before the GO signal point, the GO signal serves as their starting time point for class performance metrics. For Rider 3, the point in time when they actually start will serve as their starting time point for class performance metrics. For Riders 1, 2, and 3 who continued past the STOP signal point, their end point for class performance metrics will be the STOP signal point, while the end point for Rider 4 will be the time when they actually stopped riding.

Using such a system, live and past performance (ghost bike) data for the user or other participants, such as leaderboard content, can be provided during a class in a range of numerical and graphical formats for comparison and competition. Live and past performance data or target performance data for the user can also be displayed simultaneously to allow users to compare their performance to a benchmark in real time during or after a class. In various example embodiments, the system may also allow users to establish handicapping systems to equalize the competition among different users or user groups allowing for broad based competitions.

Figure 14A:
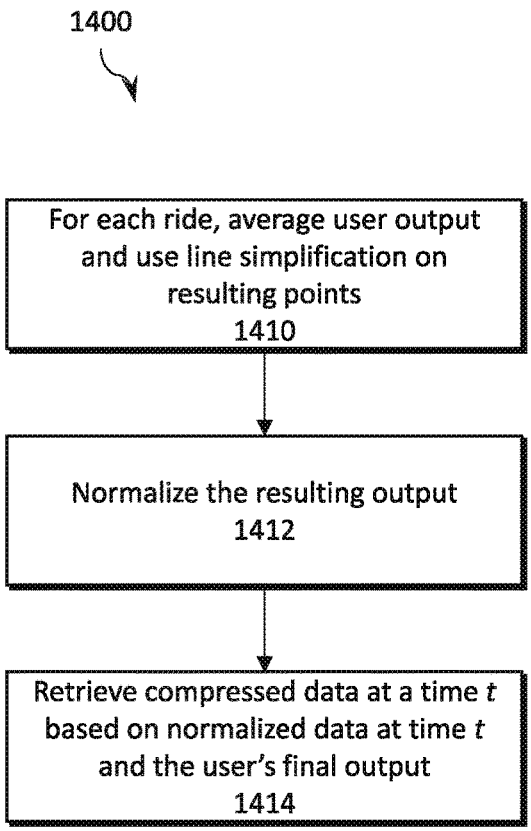
FIGS. 14A, 14B and 14C are flow diagrams illustrating example compression approaches for the storage and retrieval of computer-generated media content, in accordance with one or more embodiments of the present disclosure.

In the embodiment illustrated in FIG. 14A, a compression and retrieval process 1400 may be used for ride data that includes a set of fixed points or intervals. In step 1410, for each ride the average user output may be determined between fixed points and/or in another window/segment associated with each fixed point (e.g., a window surrounding the fixed point). The number of fixed-point values may be further reduced, for example, using a line simplification algorithm. The resulting output may then be normalized in step 1412, for example, from 0 to 1. The compressed data may be retrieved in step 1414 to calculate the user's output at one or more times 1 by retrieving the normalized output at time t and multiplying by the user's final output. In this approach, every compressed workout would have the same point indices, which would lead to more efficient data storage. One tradeoff with this approach is greater error in the derived values.

In one embodiment, the fixed points are determined through a machine learning algorithm, which may include regression analysis of the data to determine the most significant points during the ride. In some embodiments, the machine learning approach may be used to determines a formula or curve for the ride data.

Figure 14B:
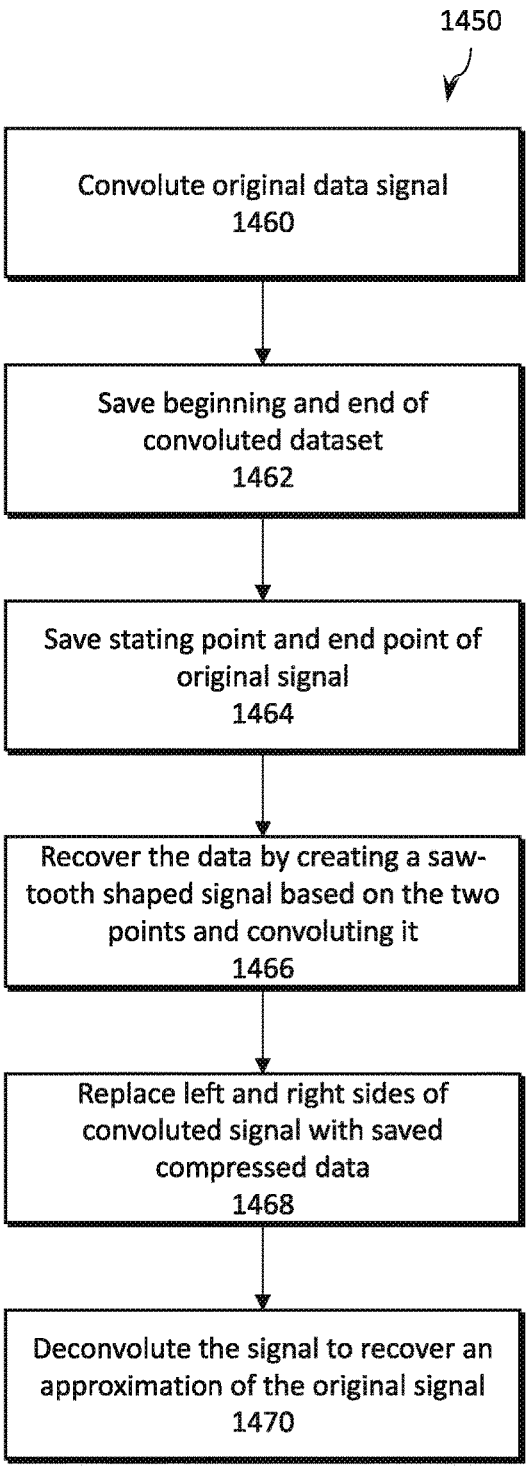

In another approach, illustrated in FIG. 14B, a signal compression and retrieval process 1450 may be implemented using a fast Fourier transform (FFT). Under this approach, the original signal is convoluted in step 1460 using the fast Fourier transform and, in step 1462, the beginning and end of the convoluted dataset is saved. In step 1464, the starting and ending points of the signal are also saved. Recovery is performed in step 1466 by creating a base saw-tooth shaped signal based on two points and then convoluting it. In step 1468, the left and right sides of the convoluted signal are replaced with the saved compressed data. The signal is then deconvoluted (e.g., inverse FFT) in step 1470, which will recover the original signal with a good approximation.

Advantages of the present embodiment will be apparent to those skilled in the art, including that the present embodiment can effectively achieve the reduction of user action and shorten the sensing time.

Figure 14C:
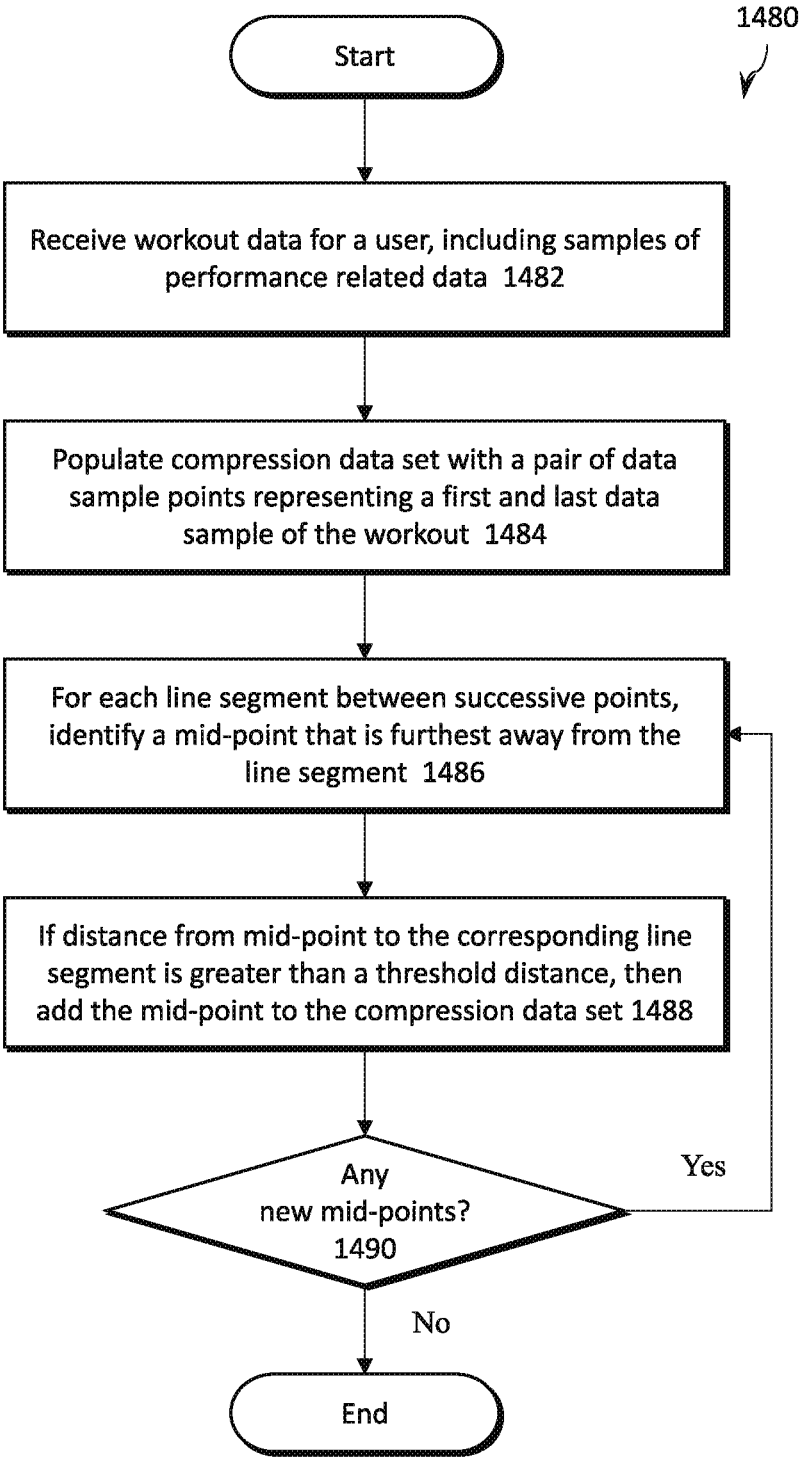

In the embodiment illustrated in FIG. 14C, an example compression process 1480 recursively samples workout data to generate a compressed dataset. In step 1482, the leaderboard system receives workout data for one or more users, including samples taken during the workout of performance-related data. For example, the data samples may include a workout time-stamp and sensed and/or calculated performance parameters such as distance traveled, speed, cadence, resistance, and/or other related data. In some embodiments, the leaderboard compression is performed using a lossy compression algorithm, such as the Ramer-Douglas-Peucker algorithm ("Douglas-Peucker algorithm"), to sample key points from each user's workout.

In some embodiments, the compression algorithm starts by identifying a first data point and last data point of the workout in step 1484, and then recursively adds midpoints between consecutive data points until an ending condition is met. In the illustrated embodiments, for each line segment between successive points, the leaderboard system identifies a mid-point that is furthest away from the line segment, in step 1486. In step 1488, if the distance from the mid-point to the corresponding line segment is greater than a predetermine threshold distance, then the mid-point is added to the compression data set. Otherwise, the mid-point is discarded without the simplified curve being worse than the threshold. The algorithm then recursively calls itself with each line segment between the points until no new points are added (step 1490). When recursion is complete, a new data set defining the workout is generated including the points that have been marked as kept and stored in a leaderboard storage.

In some embodiments, the leaderboard system is configured to generate two or more compressed sets of data for a workout to track different performance parameters. For example, the first dataset may include times for each class participant, and the second dataset may include one or more data outputs (e.g., sensed or calculated performance parameters) corresponding to those times. Both lists may be stored (e.g., in plain text, in a database, etc.) in a file that includes a workout identifier and compressed data including associated times and outputs.

In one example, a method for distributing leaderboard information to live and archived exercise classes comprises providing information about available live classes and information about available archived classes that can be accessed by a user of an exercise apparatus at a first location, receiving a selection of either a live exercise class or an archived exercise class, retrieving leaderboard data for the selected exercise class if available, decompressing the retrieved leaderboard data, and providing digital video and audio content comprising the selected exercise class to the first exercise apparatus at the first location. The method may further comprise receiving an indication of a class end condition, gathering data from the selected exercise class from one or more class participants, compressing the gathered data, and appending the compressed gathered data to the stored leaderboard data for the class. The leaderboard data may be compressed using a Ramer-Douglas-Peucker algorithm to sample data points for each user in the gathered data, and the compressed data may be stored in a folder for an exercise class, wherein each folder includes at least one folder identifying compressed data for a session of the exercise class.

In various embodiments, determining one or more performance parameters for the first user at the first location further comprises sensing at least one performance parameter from a first exercise apparatus operable by the first user at the first location. The display screen at the first location may further comprise a graphical user interface with user selectable content for display during the selected exercise class, and dynamically displaying one or more performance parameters for the second user at the second location on the display screen at the first location may further comprise displaying the first user performance parameters and second user performance parameters in a secondary window.

The digital video and audio content, first user performance parameters and second user performance parameters may be output substantially in real-time. The method may further comprise requesting the digital video content, audio content and class participant content associated with the selected exercise class from a server through the digital communications network, wherein the class participant content comprises content associated with the second user. The method may further comprise generating a leaderboard from the class participant content and the plurality of first user performance parameters, the leaderboard representing performance parameters at the same point in the selected exercise class and displaying the leaderboard at the first location. The class participant content may comprise live and archived class participant content, and the leaderboard is synchronized to the first user's performance parameters allowing for comparative class participant content to be presented to the first user.

The systems and methods for providing leaderboard compression are further enhanced when combined with the sampled leaderboard systems and methods disclosed herein. In some embodiments, a compressed sampled leaderboard is used, which allows the system to cap the all-time leaderboard used during operation to scale $O(n)$ rather than $O(n^2)$. Based on accuracy thresholds, a subset of participants is used that are representative of the data in the full compressed leaderboard. In this manner, the system can use a smaller compressed dataset while providing the user with an experience that appears to encompass the full leaderboard.

In some embodiments, the system preserves the in-class experience with a subset of users. The rank approximation methods disclosed herein converge as the exercise progresses to a final output, producing accurate ranks at the end of the exercise session. The ranking is accurate regardless of performance rank and regardless of full leaderboard size. The system does not need to approximate the leaderboard/rank for small classes and most filtering functions are not affected by using sampling when the filtered dataset is smaller than a threshold size. Additional features may include matchmaking (e.g., selecting participants for the user based on user contacts, location, interests, user configuration data, etc.) and recommended filtering (e.g., performance range, gender, age, etc.).

In some tests, a percentile sampling algorithm with a sample size of 10,000 was used. The rank vs. time converged and maximum error % of ~0.5 was achieved for each percentile ranking. The error is below approximately 0.5% regardless of leaderboard size that is being sampled (e.g., 20 k, 40 k, 75 k, 80 k, 150 k, 300 k, etc.). At all levels, the error percentage was maximum of 0.5% and the accuracy converged toward zero as the class progressed and moved closed to completion. In some embodiments, the compressed leaderboard will be filtered which can take time (e.g., compressed leaderboard size of 380 k filtering could take more than 10 seconds). In some systems, this delay will result in a timeout condition as the user experience must keep up with the class. Filtering may include, for example, age, gender or other groupings. In various tests, percentile sampling is the most accurate. Random N is acceptable, but percentile sampling consistently converges to the final rank.

Example Embodiments

Example A: A system comprises an example exercise system including a local system comprising an exercise apparatus that includes one or more sensors, a processing system that generates one or more performance metrics and a display for displaying an exercise class, performance metrics, and a sampled leaderboard comparing user performance to other users.

Example B: The system of example A wherein the exercise system comprises an exercise cycle, a treadmill, a rowing machine, a weight machine or other exercise equipment.

Example C: The system of examples A-B, wherein the sensors measure movement and/or settings of the exercise apparatus, such as cadence, power, and/or resistance on an exercise cycle, and wherein the sensors include a heart rate monitor, an image or video capture component (e.g., a camera) capturing images of the user during exercise, and/or other sensors as appropriate for the exercise apparatus.

Example D: The system of examples A-C, wherein the processing system comprises memory and exercise logic comprising machine readable instructions for execution by the processor.

Example E: The system of examples A-D wherein the local system is configured to transmit session data to the distribution platform, wherein the session data includes sensor data (e.g., resistance, cadence, user heartrate), performance metrics (e.g., speed, distance, position on leaderboard), user preference information (e.g., favorite music, workout preferences), and/or other session data.

Example F: The system of examples A-E wherein the distribution platform is configured to serve media associated with the exercise class (e.g., video, audio and other workout content from a workout/media content database, and leaderboard information from a leaderboard system) to the local system.

Example G: The system of examples A-F, wherein the leaderboard information may include the full leaderboard, a filtered leaderboard and/or a sampled leaderboard.

Example H: The system of examples A-G, wherein the distribution platform 120 and/or the local system provide workout data to a leaderboard system that is configured to compile, compress and store workout data in a leaderboard database.

Example I: The system of examples A-H, wherein the leaderboard system is configured to retrieve stored leaderboard data and generate a leaderboard for display to the user of the local system during an exercise session.

Example J: The system of examples A-I wherein the distribution platform includes logic for filtering and/or sampling the generated leaderboard, wherein the filtering logic is configured to generate a subset of the leaderboard for display to the user, which may be based on user selected criteria such as friends or contacts of the user, location, age, gender, performance metrics, etc.

Example K: The system of examples A-J, wherein the sampling logic is configured to reduce the size of leaderboard in accordance with system constraints while providing the user with simulated competition against the full leaderboard during the exercise class.

Example L: A method for operating the system of examples A-K comprising receiving a request from a local system (e.g., an exercise cycle) to start an on-demand class, downloading the leaderboard for the selected on-demand class, optionally applying a filter to the leaderboard to generate a filtered leaderboard for the user, determining if the size of the leaderboard to be downloaded to the local system is less than a threshold value, and generating a sampled leaderboard if the size of the leaderboard to be downloaded is greater than the threshold.

Example M: A method for operating the system of examples A-K and/or performing the method of example L comprising updating the sampled leaderboard to find output data for the current timestamp associated with the exercise class, sorting the leaderboard by the extracted output to generate a ranked leaderboard corresponding to the designated timestamp for the exercise class, incorporating users currently taking the exercise class into the ranking using their current output metrics, determining the user's approximate rank on the leaderboard, and displaying on the local system comparative performance results for the user.

Example N: A method for operating the system of examples A-K and/or performing the methods of examples L-M comprising sorting the sampled leaderboard based on the total performance output of each user for the current portion of the exercise session, and determining the current user's position in the sorted sampled leaderboard, calculating the spacing between workouts nearby the current user based on the associated output values, calculating spacing to project the user's rank onto the full all-time leaderboard, and populating a leaderboard window on the user's display using the user's approximate rank to rank the other sampled workouts to ensure the leaderboard maintains its large feel.

The foregoing disclosure is not intended to limit the present invention to the precise forms or particular fields of use disclosed. As such, it is contemplated that various alternate embodiments and/or modifications to the present disclosure, whether explicitly described or implied herein, are possible in light of the disclosure. Further, it should be understood that the systems and methods described with respect to any of the FIGS. 1A-14C may be implemented with the systems and methods described in one or more other of FIGS. 1A-14C. Having thus described embodiments of the present disclosure, persons of ordinary skill in the art will recognize advantages over conventional approaches and that changes may be made in form and detail without departing from the scope of the present disclosure. Thus, the present disclosure is limited only by the claims.

What is claimed is:

1. A system comprising:

an exercise apparatus comprising one or more sensors;

a processing system configured to generate one or more performance metrics based at least in part on signals received from the one or more sensors; and a display configured to display exercise class content, at least one performance metric, and a leaderboard comparing a current performance of a user during an exercise class to stored class participant data;

wherein the displayed leaderboard comprises a ranking of a user of the exercise apparatus and a plurality of class participants from a sampled leaderboard comprising a subset of the stored class participant data; and wherein the displayed ranking approximates the user's ranking in the stored class participant data; and wherein the subset of the stored class participant data comprises compressed class participant data that is decompressed in real-time during the exercise class to generate the displayed leaderboard and approximate user ranking corresponding to a user position in the exercise class.

2. The system of claim 1, further comprising a distribution server configured to:

receive a request from the processing system to start the exercise class;

deliver the exercise class content to the processing system;

download the sampled leaderboard to the processing system, wherein the sampled leaderboard data is generated by:

determining whether the stored class participant data has a size greater than a threshold value;

generating the sampled leaderboard if the class participant data has a size greater than the threshold value; and downloading the sampled leaderboard to the processing system.

3. The system of claim 2, wherein the sampled leaderboard data is further generated by:

receiving filter criteria from the processing system comprising one or more class participant identifiers, geographic locations, ages, genders, and/or performance metrics;

filtering the stored class participant data using the filter criteria to generate a filtered leaderboard of stored class participant data;

determining whether the filtered leaderboard of stored class participant data has a size greater than the threshold value; and generating the sampled leaderboard from the filtered leaderboard if the filtered leaderboard of class participant data has a size greater than the threshold value.

4. The system of claim 1, wherein the processing system is further configured to sort the sampled leaderboard by the performance metric to generate a ranked leaderboard corresponding to an identified timestamp associated with the exercise class;

determine a ranking of the user's performance metric at the identified timestamp on the ranked leaderboard; and display a subset of the ranked leaderboard, including the user as ranked therein.

5. The system of claim 1, wherein the user's ranking in the stored class participant data is approximated by calculating a spacing between selected class participant data in the sampled leaderboard based on corresponding performance metrics, and interpolating the user's rank in the stored class participant data based at least in part on proximately ranked class participants in the sampled leaderboard;

wherein the processing system is further configured to populate the displayed leaderboard including the user's approximate rank and a subset of proximately ranked class participants from the sampled leaderboard.

6. The system of claim 1, wherein the class participant data is compressed for each class participant by selecting performance data for a plurality of points in time from each class participant's exercise session, wherein the plurality of points in time are selected by, for each successive pair of selected points identifying a mid-point that is furthest away from a line segment between the successive pair of points, and adding the mid-point to the plurality of points in time if a distance between the mid-point and the line segment is greater than a predetermined threshold.

7. A method comprising:

receiving a request from a local exercise system to start an on-demand class;

delivering content for the on-demand class to the local exercise system, including class leaderboard data, wherein the class leaderboard data is generated by:

determining whether stored class participant data for the on-demand class has a size greater than a threshold value, wherein the stored class participant data comprises compressed class participant data;

generating a sampled leaderboard from the compressed class participant data when the class participant data has a size greater than the threshold value;

decompressing the sampled leaderboard data in real-time during the on-demand class; and downloading the sampled leaderboard to the local exercise system as the class leaderboard data.

8. The method of claim 7, wherein the class leaderboard data is further generated by:

applying filter criteria to stored class participant data for the on-demand class to generate a filtered leaderboard;

determining whether the filtered leaderboard has a size less than the threshold value; and generating the sampled leaderboard from the filtered leaderboard when a size of the filtered leaderboard is greater than the threshold value.

9. The method of claim 7, further comprising:

displaying exercise class content for a user of the local exercise system, including at least one user performance metric, and a ranked leaderboard comparing a performance of the user during the exercise class to stored class participant data from the sampled leaderboard;

wherein the ranked leaderboard comprises a ranking of the user and a plurality of class participants from the sampled leaderboard; and wherein the displayed ranking approximates the user's ranking in the stored class participant data.

10. The method of claim 9, further comprising updating the ranked leaderboard for an identified timestamp in the on-demand class by sorting the class participant data of the sampled leaderboard by corresponding user performance metric values at the identified timestamp.

11. The method of claim 10, further comprising determining the approximate ranking of the user in the stored class participant data by calculating a spacing between class participant data proximate to the user's ranking in the updated ranked leaderboard, and projecting a rank for the user in the stored class participant data based at least in part on a ranking of proximate class participants in the sampled leaderboard and the calculated spacing.

12. The method of claim 7 wherein generating a sampled leaderboard comprises:

sorting the stored class participant data by a performance metric; and populating the sampled leaderboard by selecting every nth class participant from the sorted stored class participant data, where n is selected such that the populated sampled leaderboard has a size less than the threshold.

13. The method of claim 7, further wherein the class participant data is compressed for each class participant by selecting performance data for a plurality of points in time from each class participant's exercise session, wherein the plurality of points in time are selected by, for each successive pair of selected points identifying a mid-point that is furthest away from a line segment between the successive pair of points, and adding the mid-point to the plurality of points in time if a distance between the mid-point and the line segment is greater than a predetermined threshold; and wherein the method further comprises decompressing the class participant data during the exercise class to extract performance metrics to generate a displayed leaderboard and approximated user ranking corresponding to a performance of the local exercise system in the exercise class.

14. A method comprising:

receiving leaderboard data for a session of an on-demand exercise class, the leaderboard data comprising a full leaderboard of stored class participant data from prior sessions of the on-demand exercise class, wherein the stored class participant data comprises compressed class participant data;

evaluating the received leaderboard data for real-time processing during the session of the on-demand exercise class, based at least in part on processing and/or communication bandwidth constraints;

sampling, based on the evaluation of the received leaderboard data, the leaderboard data by selecting data corresponding to a subset of prior class participants to generate a sampled leaderboard;

decompressing a subset of compressed class participant data corresponding to the sampled leaderboard in real-time and during the session of the on-demand exercise class;

ranking user performance during the session of the on-demand exercise class; and projecting a user's ranking in the full leaderboard, based at least in part on the user performance and ranking on the sampled leaderboard.

15. The method of claim 14, wherein the sampled leaderboard data is further generated by:

applying filter criteria to stored class participant data for the on-demand class to generate a filtered leaderboard;

determining whether the filtered leaderboard has a size less than a threshold value; and generating the sampled leaderboard from the filtered leaderboard when a size of the filtered leaderboard is greater than the threshold value.

16. The method of claim 14, further comprising:

displaying exercise class content for a user of a local exercise system, including at least one user performance metric, and a ranked leaderboard comparing a performance of the user during the exercise class to stored class participant data from the sampled leaderboard; and updating the ranked leaderboard for an identified timestamp in the on-demand class by sorting the class participant data of the sampled leaderboard by corresponding user performance metric values at the identified timestamp; and approximating a ranking of the user in the stored class participant data by calculating a spacing between class participant data proximate to the user's ranking in the updated ranked leaderboard, and projecting a rank for the user in the stored class participant data based at least in part on a ranking of proximate class participants in the ranked leaderboard and the calculated spacing.

17. The method of claim 14, wherein generating the sampled leaderboard comprises:

sorting the stored class participant data by the performance metric; and populating the sampled leaderboard by selecting every nth class participant from the sorted stored class participant data, where n is selected such that the populated sampled leaderboard has a size less than a threshold value.

18. The method of claim 14, wherein generating the sampled leaderboard comprises:

populating the sampled leaderboard by randomly selecting class participants from the class participant data; and/or determining a user's expected performance output based at least in part on the user's prior performance metrics and populating the sampled leaderboard by selecting class participants from the class participant data based at least in part on corresponding performance metrics.

19. The method of claim 14, further wherein the class participant data is compressed for each class participant by selecting performance data for a plurality of points in time from each class participant's exercise session, wherein the plurality of points in time are selected by, for each successive pair of selected points identifying a mid-point that is furthest away from a line segment between the successive pair of points, and adding the mid-point to the plurality of points in time if a distance between the mid-point and the line segment is greater than a predetermined threshold.

20. The method of claim 14, further comprising:

storing the compressed class participant data for the on-demand exercise class in a single file comprising compressed workout data appended for each prior session of the on-demand exercise class.

* * * * *